US010122085B2

(12) United States Patent
Goyette et al.

(10) Patent No.: US 10,122,085 B2
(45) Date of Patent: Nov. 6, 2018

(54) FEED RE-POINTING TECHNIQUE FOR MULTIPLE SHAPED BEAMS REFLECTOR ANTENNAS

(71) Applicant: THE BOEING COMPANY, Chicago, IL (US)

(72) Inventors: Guy Goyette, Chicago, IL (US); Parthasarathy Ramanujam, Chicago, IL (US); Daniel F. Mathews, Chicago, IL (US)

(73) Assignee: The Boeing Company, Chicago, IL (US)

( * ) Notice: Subject to any disclaimer, the term of this patent is extended or adjusted under 35 U.S.C. 154(b) by 613 days.

(21) Appl. No.: 14/570,980

(22) Filed: Dec. 15, 2014

(65) Prior Publication Data

US 2016/0172756 A1 Jun. 16, 2016

(51) Int. Cl.

| | |
|---|---|
| ***H01Q 3/00*** | (2006.01) |
| ***H01Q 3/40*** | (2006.01) |
| ***H01Q 25/00*** | (2006.01) |
| ***H01Q 15/14*** | (2006.01) |
| ***H01Q 3/22*** | (2006.01) |
| *H01Q 3/18* | (2006.01) |
| *H01Q 19/13* | (2006.01) |

(52) U.S. Cl.

CPC ..... *H01Q 3/40* (2013.01); *H01Q 3/22* (2013.01); *H01Q 15/14* (2013.01); *H01Q 15/148* (2013.01); *H01Q 25/007* (2013.01); *H01Q 3/18* (2013.01); *H01Q 19/13* (2013.01)

(58) Field of Classification Search

CPC .. H01Q 3/40; H01Q 3/18; H01Q 3/22; H01Q 15/14; H01Q 15/148; H01Q 25/007

USPC ..... 342/373, 368, 372

See application file for complete search history.

(56) References Cited

U.S. PATENT DOCUMENTS 3,745,582 A * 7/1973 Karikomi ..... H01Q 3/16 343/758
3,755,815 A * 8/1973 Stangel ..... H01Q 3/34 342/371
3,775,769 A * 11/1973 Heeren ..... G01S 13/685 342/376
3,852,763 A 12/1974 Kreutel et al.
4,298,877 A * 11/1981 Sletten ..... H01Q 1/1264 343/781 CA (Continued)

OTHER PUBLICATIONS

"Converging and Diverging Surfaces—UMD Physics" www.physics.umd.edu/courses/Phys106/rolston/Lectures/Lec10.pdf.*

(Continued)

*Primary Examiner* — Chuong P Nguyen
(74) *Attorney, Agent, or Firm* — Haynes and Boone, LLP

(57) ABSTRACT

Systems, methods, and apparatus for re-pointing at least one beam are disclosed. In one or more embodiments, the disclosed method involves receiving and/or transmitting, with at least one feed, electromagnetic (EM) energy towards a non-parabolic reflector. In at least one embodiment, reflected EM energy that is reflected from the non-parabolic reflector originates from and/or generates at least one beam. The method further involves rotating, at least one feed, from at least one first angular position to at least one second angular position, such that at least one beam shifts from at least one first coverage location to at least one second coverage location.

20 Claims, 19 Drawing Sheets

(56) References Cited

U.S. PATENT DOCUMENTS 5,936,592 A 8/1999 Ramanujam et al.
5,977,923 A * 11/1999 Contu ..... H01Q 19/192 343/761
6,137,451 A 10/2000 Durvasula et al.
6,225,964 B1 * 5/2001 Fermelia ..... H01Q 15/22 343/756
6,255,997 B1 * 7/2001 Ratkorn ..... H01Q 15/147 343/781 R
6,366,257 B1 * 4/2002 Ramanujam ..... H01Q 1/288 343/755
6,456,252 B1 * 9/2002 Goyette ..... H01Q 3/2658 343/779
6,621,461 B1 * 9/2003 Ramanujam ..... H01Q 1/288 343/753
6,664,933 B2 12/2003 Spirtus
6,667,720 B1 * 12/2003 Anderton ..... H01Q 3/20 343/757
6,795,034 B2 * 9/2004 Lyerly ..... H01Q 19/19 343/781 CA
6,943,745 B2 * 9/2005 Rao ..... H01Q 1/288 343/757
7,205,949 B2 * 4/2007 Turner ..... H01Q 1/288 343/779
7,710,340 B2 * 5/2010 Rao ..... H01Q 19/10 343/778
8,354,956 B2 * 1/2013 Matyas ..... H01Q 19/12 342/354
9,601,827 B2 * 3/2017 Yamamoto ..... H01Q 3/18
2004/0263418 A1 12/2004 Kuroda et al.
2009/0015498 A1 1/2009 Deng et al.

OTHER PUBLICATIONS

Philippou, et al., "Shaped Reflectors for Multiple Beam Applications", Multiple Beam Antennas and Beamformers, IEEE Colloquium on Nov. 21, 1989, pp. 3/1-3/3, INSPEC Accession No. 3590395, Conference Location: London, Publisher: IET.

Extended European Search Report, EU Patent Application No. 15191231.8-1811, dated Apr. 26, 2016.

Communication pursuant to Article 94(3) EPC dated May 9, 2017 in European Patent Application No. 15 191 231.8-1927 (10pages).

* cited by examiner $$BDF\ (deg/deg) = \frac{\theta_2}{\theta_1} = \frac{1 + K * (D/4F)^2}{1 + (D/4F)^2}$$

$$BDF\ (deg/length) = \sin^{-1}(1/L) * BDF\ (deg/deg)$$

| Surface | Feed Pointing | | Beam |
|---|---|---|---|
| Diverging | Diverging | | Converging |
| Diverging | Converging | | Diverging |
| Converging | Diverging | | Diverging |
| Converging | Converging | | Converging |

FEED RE-POINTING TECHNIQUE FOR MULTIPLE SHAPED BEAMS REFLECTOR ANTENNAS

FIELD

The present disclosure relates to feed re-pointing techniques. In particular, it relates to feed re-pointing techniques for multiple shaped beams reflector antennas.

BACKGROUND

Coverage locations of multi-beam antennas often require too large of a feed separation for certain antenna packaging (e.g., the feeds cannot fit mechanically on a desired satellite platform). In some of these cases, an additional antenna, which leads to an increase in cost, is needed to produce an extra beam that is required to fulfill the mission. Conversely, in other instances, coverage locations of multi-bean antennas require too close of feed locations that result in feed interference with one another.

As such, there is a need for a technique for multi-beam antennas that is able to produce the desired coverage locations while maintaining physically practical feed locations.

SUMMARY

The present disclosure relates to a method, system, and apparatus for a feed re-pointing technique for multiple shaped beams reflector antennas. In one or more embodiments, a method for re-pointing at least one beam involves receiving and/or transmitting, with at least one feed, electromagnetic (EM) energy towards a non-parabolic reflector. In one or more embodiments, reflected EM energy that is reflected from the non-parabolic reflector originates from and/or generates at least one beam. The method further involves rotating, at least one feed, from at least one first angular position to at least one second angular position, such that at least one beam shifts from at least one first coverage location to at least one second coverage location.

In one or more embodiments, the method further involves translating, at least one feed, from at least one first feed location to at least one second feed location.

In at least one embodiment, at least one first feed location is at a focal point.

In one or more embodiments, at least one first coverage location and at least one second coverage location are the same location or are different locations.

In at least one embodiment, the non-parabolic reflector comprises a diverging surface or a converging surface.

In one or more embodiments, at least one feed is a transmit feed, a receive feed, or a transmit and/or receive feed.

In at least one embodiment, at least one feed is a linearly polarized feed or circularly polarized feed.

In one or more embodiments, at least one first coverage location is located on Earth, a celestial body, a spacecraft, and/or a satellite.

In at least one embodiment, at least one second coverage location is located on Earth, a celestial body, a spacecraft, and/or a satellite.

In one or more embodiments, the non-parabolic reflector comprises a deformable body.

In at least one embodiment, at least one feed is rotated in azimuth and/or elevation.

In one or more embodiments, a system for re-pointing at least one beam involves a non-parabolic reflector. In at least one embodiment, reflected EM energy that is reflected from the non-parabolic reflector originates from and/or generates at least one beam. The system further involves at least one feed to receive and/or transmit electromagnetic (EM) energy towards the non-parabolic reflector, and to rotate from at least one first angular position to at least one second angular position, such that at least one beam shifts from at least one first coverage location to at least one second coverage location.

In at least one embodiment, at least one feed is further to translate from at least one first feed location to at least one second feed location.

In one or more embodiments, at least one feed rotates in azimuth and/or elevation.

The features, functions, and advantages can be achieved independently in various embodiments of the present disclosure or may be combined in yet other embodiments.

DRAWINGS

These and other features, aspects, and advantages of the present disclosure will become better understood with regard to the following description, appended claims, and accompanying drawings where:

FIGS. 1A-7B illustrate basic reflector antenna concepts.

FIG. 1A is a diagram depicting the beam deviation factor for a parabolic reflector.

FIG. 1B shows beam deviation factor formulas.

FIG. 7B is a graph showing the beam directivity associated with FIG. 7A.

FIGS. 8A-16 illustrate the disclosed system and method for feed re-pointing for multiple shaped beams reflector antennas, in accordance with multiple embodiments of the present disclosure.

FIG. 8A is a diagram illustrating ray tracing for diverging reflector, when the feed is located at the focal point and rotated, in accordance with at least one embodiment of the present disclosure.

FIG. 14 shows a table and associated beam diagrams for feed re-pointing versus beam shifting, in accordance with at least one embodiment of the present disclosure.

FIG. 16 depicts a flow chart depicting the disclosed method for feed re-pointing for multiple shaped beams reflector antennas, in accordance with at least one embodiment of the present disclosure.

DESCRIPTION

Figures 1A, 1B:
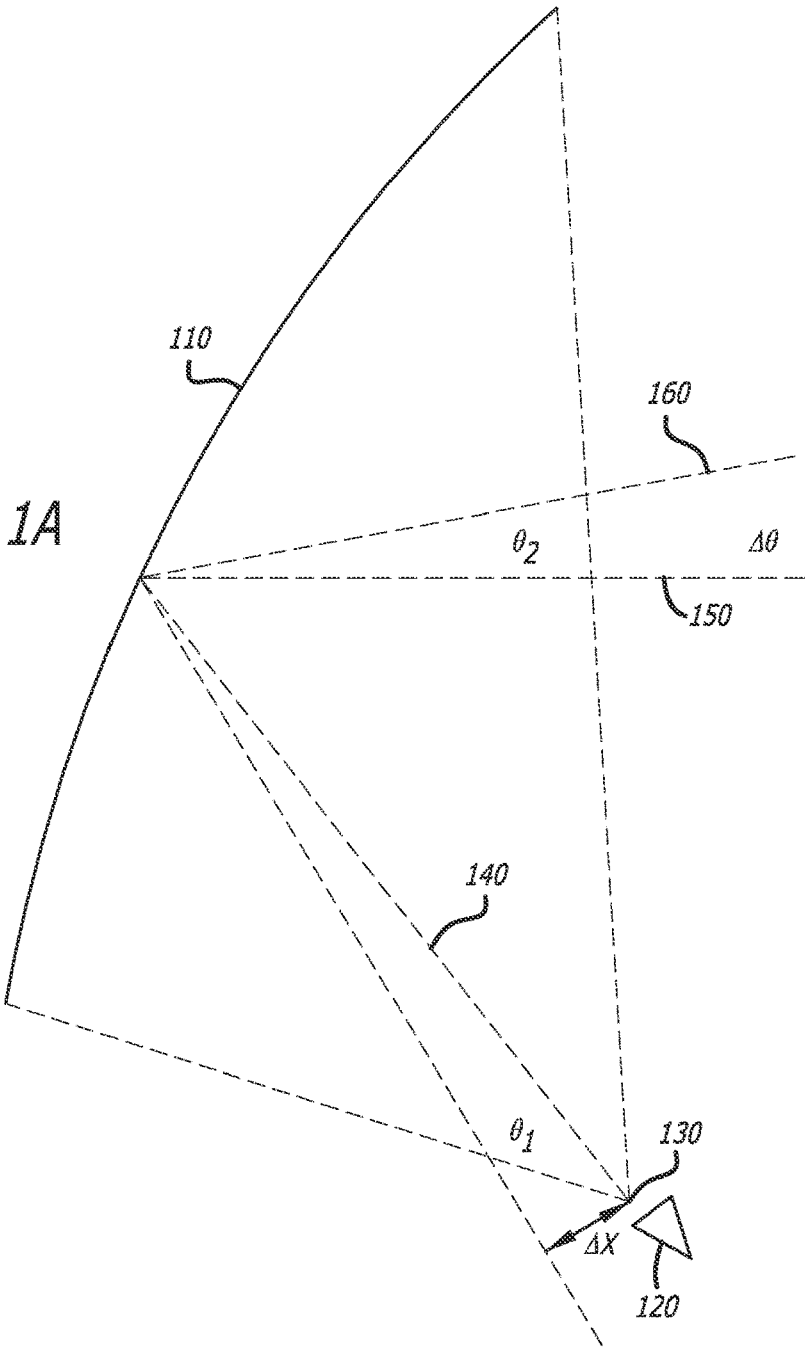

The methods and apparatus disclosed herein provide an operative system for feed re-pointing techniques for multiple shaped beams reflector antennas. The disclosed system employs multi shaped beams reflector antennas comprising at least one feed. The disclosed feed re-pointing technique can be advantageously used to orient a geometrical optics (GO) starting solution of the shaped antenna beams at the required coverage location (e.g., on Earth, a celestial body, a spacecraft, and/or a satellite), while maintaining the feed locations in a position that can be packaged.

As previously mentioned above, coverage locations of multi-beam antennas often require too large of a feed separation for certain antenna packaging (e.g., the feeds cannot physically fit mechanically on a desired satellite platform). In some cases, an additional antenna, which leads to an increase in cost, is required to produce an extra beam, which is needed to fulfill the mission. Conversely, in other instances, coverage locations of multi-bean antennas require too close of feed locations that result in feed interference with one another. The present disclosure proposes a novel feed-to-beam relationship that allows for greater flexibility of where a feed (or antenna) may be placed on a given platform, thereby reducing the number of feeds (or antennas) necessary to meet a variety of design criteria.

The disclosed system and method for feed re-pointing techniques for multiple shaped beams reflector antennas can be used advantageously in applications where more than one shaped beam is produced by the same reflector system. A typical case is when two feeds are illuminating a reflector surface to produce two shaped beams. From, for example, a satellite orbital location, the beams will have to be pointing at two different regions specified on Earth. As previously mentioned above, the beams can be shifted to the desired coverage regions by using feed translation.

However, there are some situations where using feed translation alone to shift the beams to the desired coverage regions causes problems. One such situation is when the required feed spacing to be able to illuminate the two regions specified is too large and the feeds result in mechanical interference with other objects on the satellite platform, for example, and possibly these feed locations create scattering with other antennas or objects. Another such situation when the two regions to illuminate may be too close to each other (e.g., they may even be overlapping), thereby resulting in the feeds generating the beams having mechanical interference with each other. In both of these situations, the use of feed re-pointing along with a shaped reflector surface, as disclosed, can allow for the feed locations to be adjusted to acceptable mechanical locations, while generating the required beams. It should be noted that an example of two feeds producing overlapping beams is shown in FIGS. 9-12.

It should be noted that, with beams produced by a parabolic reflector, there is a direct relationship between the feed location, which is at a location a distance $\Delta x$ from the reflector focal point, and the direction of the beam that it produces relative to the reflector boresight direction (ΔΘ). When more than a single beam is produced by the reflector using two or more feeds, the direction of the beams that are produced are limited by the mechanical constraints imposed by the packaging of the corresponding feeds. This restricts how close the beams can be or how far apart they can be and still be able to package the feeds.

For shaped reflectors, the beam deviation factor (BDF) will depend upon the degree of shaping of the beam and on the type of shaping solution (e.g., converging or diverging). In addition, with shaped reflectors, the re-pointing of the feed can also shift the beam.

With shaped beams, the disclosed system and method takes advantage of this "beam shift" versus "re-pointing" relationship for multiple shaped beams. It allows for the adjustment of the desired beam direction, while maintaining the feed locations such that the feeds can be packaged. Using this disclosed technique, the same reflector can even be used to produce two beams (or more) that are practically completely overlapped.

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

Embodiments of the present disclosure may be described herein in terms of functional and/or logical components and various processing steps. It should be appreciated that such components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions (e.g., the translation and rotation of a feed(s)) under the control of one or more microprocessors or other control devices. In addition, those skilled in the art will appreciate that embodiments of the present disclosure may be practiced in conjunction with, and that the system described herein is merely one example embodiment of the present disclosure.

For the sake of brevity, conventional techniques and components related to multi shaped beams reflector antennas, and other functional aspects of the system (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

FIGS. 1A-7B illustrate basic reflector antenna concepts.

FIG. 1A is a diagram 100 depicting the beam deviation factor for a parabolic reflector 110. In this figure, a feed 120 is initially located at the focal point 130 of the reflector 110. At this position, a bisector line 140 of length L is shown. When the feed 120 is transmitting, the feed 120 is radiating electromagnetic (EM) energy (e.g., radio frequency (RF) energy) towards the reflector 110, and a beam 150 is reflected off the reflector 110. Conversely, when the feed 120 is receiving, the feed 120 is receiving EM energy (e.g., RF energy) that is reflected from the reflector.

When the feed 120 is translated (or moved) by distance Δx away from the focal point 130, the beam 160 reflected off the reflector 110 is shifted by an angle ΔΘ, where ΔΘ equals the beam deviation factor (BDF) multiplied (*) by Δx. It should be noted that the rotating (or re-pointing) of the feed 120 does not significantly shift the beam 150 reflected off the reflector 110.

FIG. 1B shows beam deviation factor formulas. In this figure, for equation 1 (EQU 1) and equation 2 (EQU 2), D is the reflector diameter, F is the focal length, and K is approximately equal to 0.36. K varies between 0.3 and 0.7, with its value increasing with the aperture (i.e. reflector) taper.

Figure 2B:
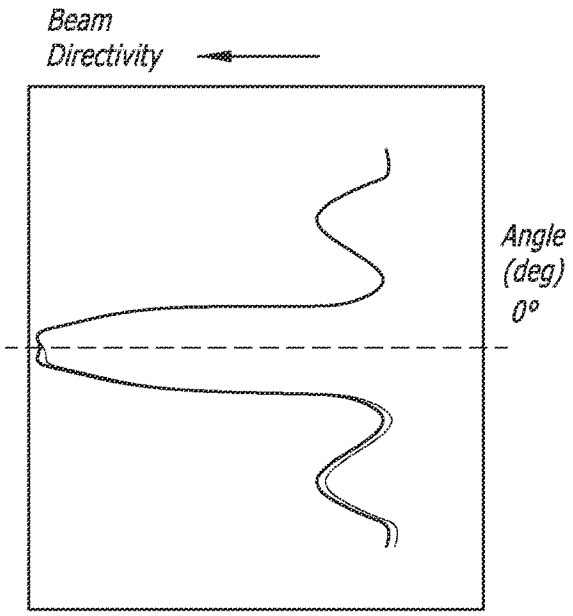
FIG. 2B is a graph showing the beam directivity associated with FIG. 2A.
Figure 2A:
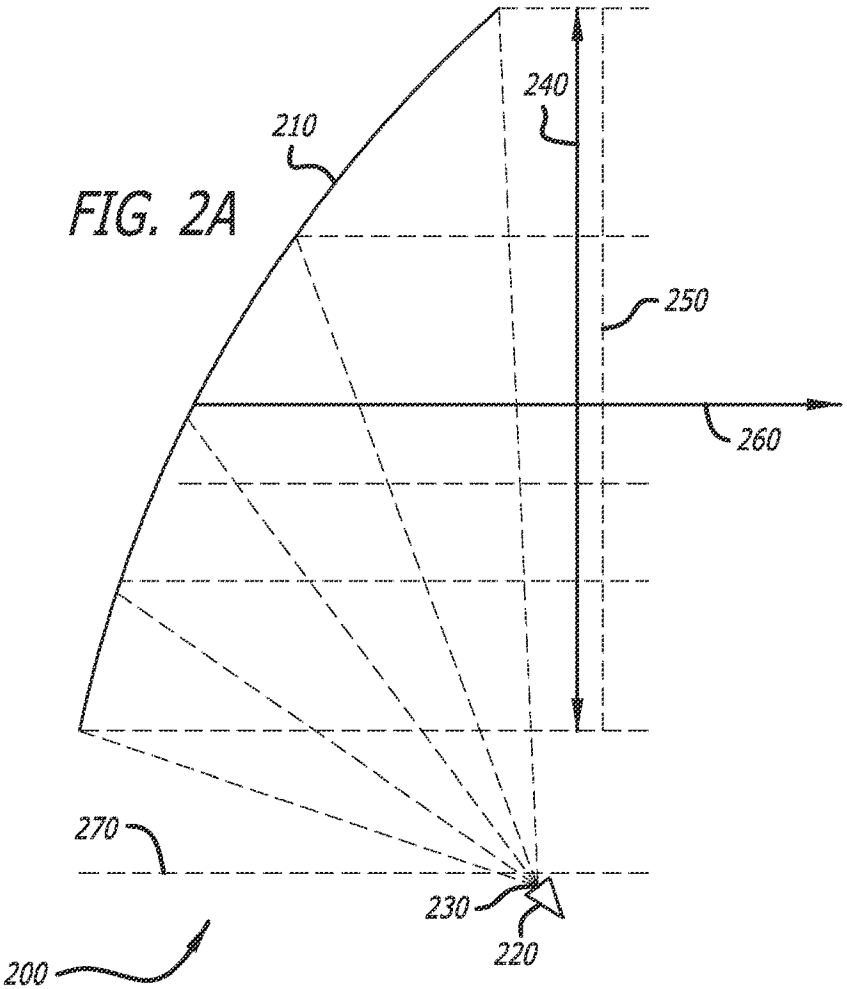
FIG. 2A is a diagram showing ray tracing for a parabolic reflector, when the feed is located at the focal point.

FIG. 2A is a diagram 200 showing ray tracing for a parabolic reflector 210, when the feed 220 is located at the reflector focal point 230. In this figure, it is shown that for a parabolic reflector 210, all rays from the focal point 230 to the aperture plane 240 have the same length. This results in a constant planar phase front 250 in the reflector aperture. The uniform planar phase front 250, produced by the rays coming from the feed, determines the beam direction.

It should be noted that, for a parabolic reflector 210, the location of the feed 220 with respect to the focal point 230 determines the beam direction. In the example shown in FIG. 2A, the feed 220 is located at the focal point 230, thereby resulting in a beam in the boresight 260 direction. The reflector boresight 260 is parallel to the parabola focal axis 270.

It should be noted that the nominal direction in the present disclosure is referenced as the boresight 260 direction (i.e. 0 degrees). However, it should be noted that the boresight direction 260 is arbitrary, and that the reference direction along with the nominal feed location can be chosen arbitrarily.

FIG. 2B is a graph showing the beam directivity associated with FIG. 2A. In this figure, the beam directivity pattern is shown to be roughly centered about the zero degrees (0°) axis corresponding to the antenna Boresight direction.

Figure 3B:
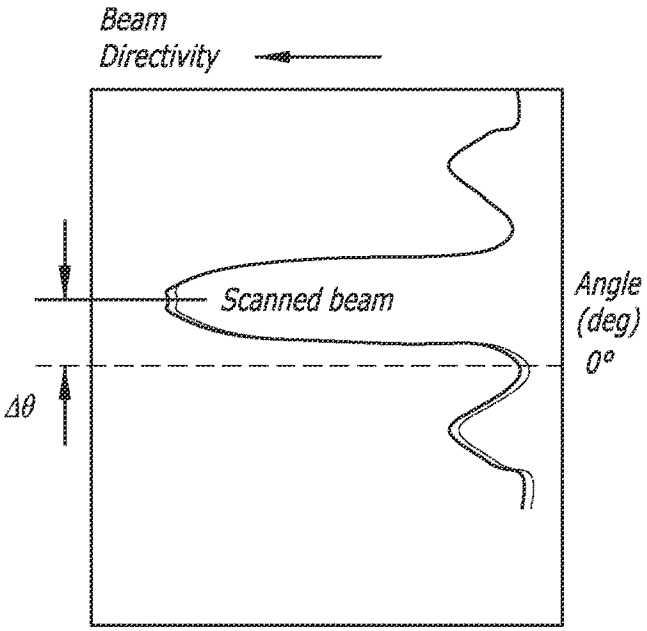
FIG. 3B is a graph showing the beam directivity associated with FIG. 3A.
Figure 3A:
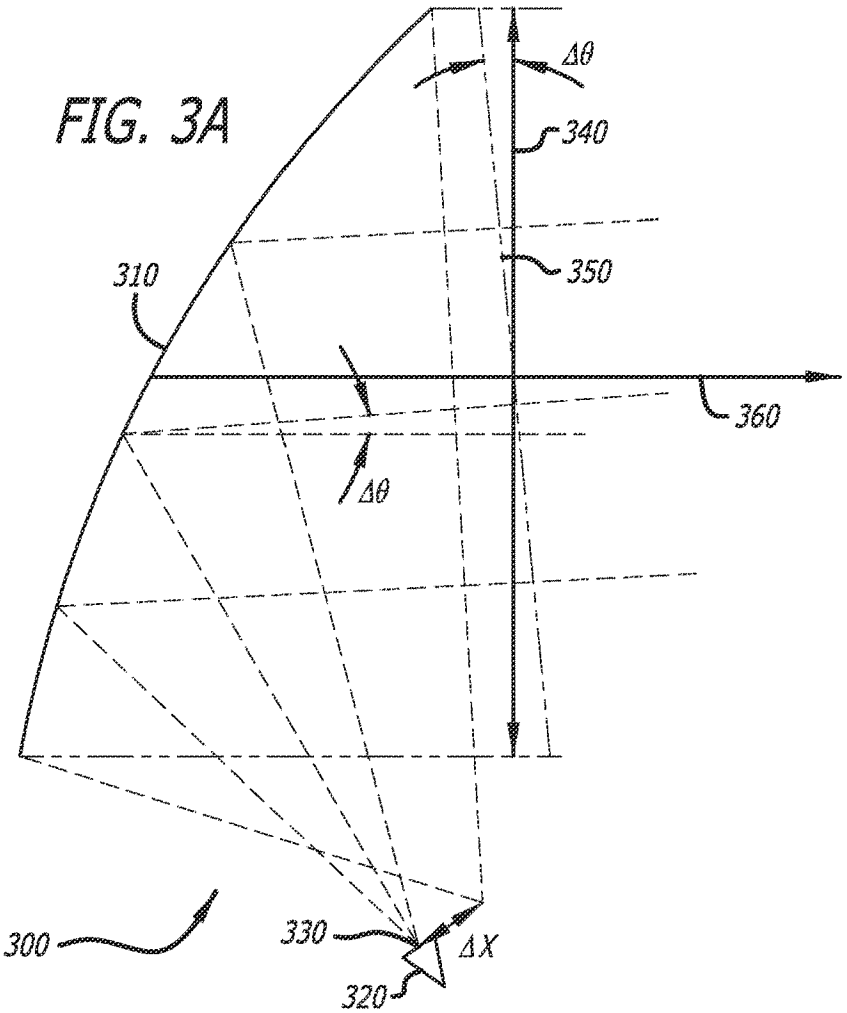
FIG. 3A is a diagram illustrating ray tracing for a parabolic reflector, when the feed is translated away from the focal point.

FIG. 3A is a diagram 300 illustrating ray tracing for a parabolic reflector 310, when the feed 320 is translated away from the focal point 330. As shown in this figure, when the feed 320 is translated in the focal plane by a distance Δx away from the focal point 330, all of the rays are reflected with approximately the same angle with a shift in ΔΘ with respect to the reflector boresight 360 direction. This also results in a uniform phase front 350, but the phase front 350 is inclined by ΔΘ with respect to the aperture plane 340, thereby resulting in a beam shift of ΔΘ with respect to the boresight 360 direction.

It should be noted that, for a parabolic reflector 310, moving the feed 320 allows a shift in the beam direction. In the example shown in FIG. 3A, the feed 320 is translated by a distance Δx with respect to the focal point 330, thereby resulting in a beam shift of ΔΘ.

FIG. 3B is a graph showing the beam directivity associated with FIG. 3A. In this figure, the beam directivity pattern is shown to be scanned a distance ΔΘ from 0° axis.

Figure 4B:
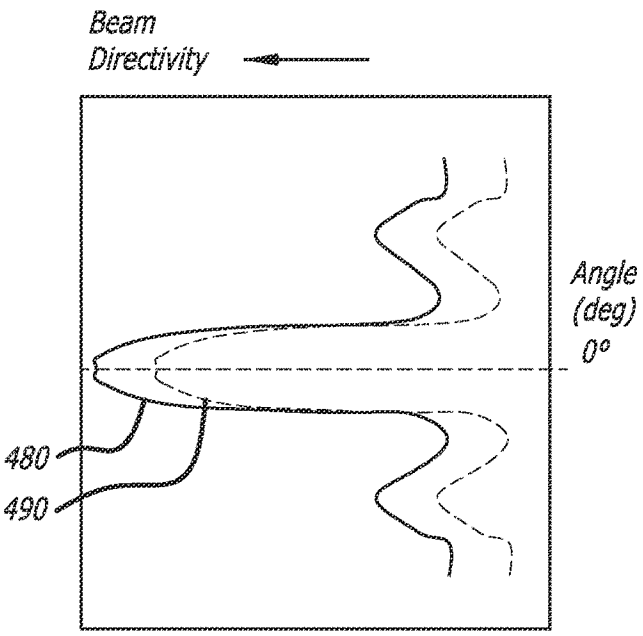
FIG. 4B is a graph showing the beam directivity associated with FIG. 4A.
Figure 4A:
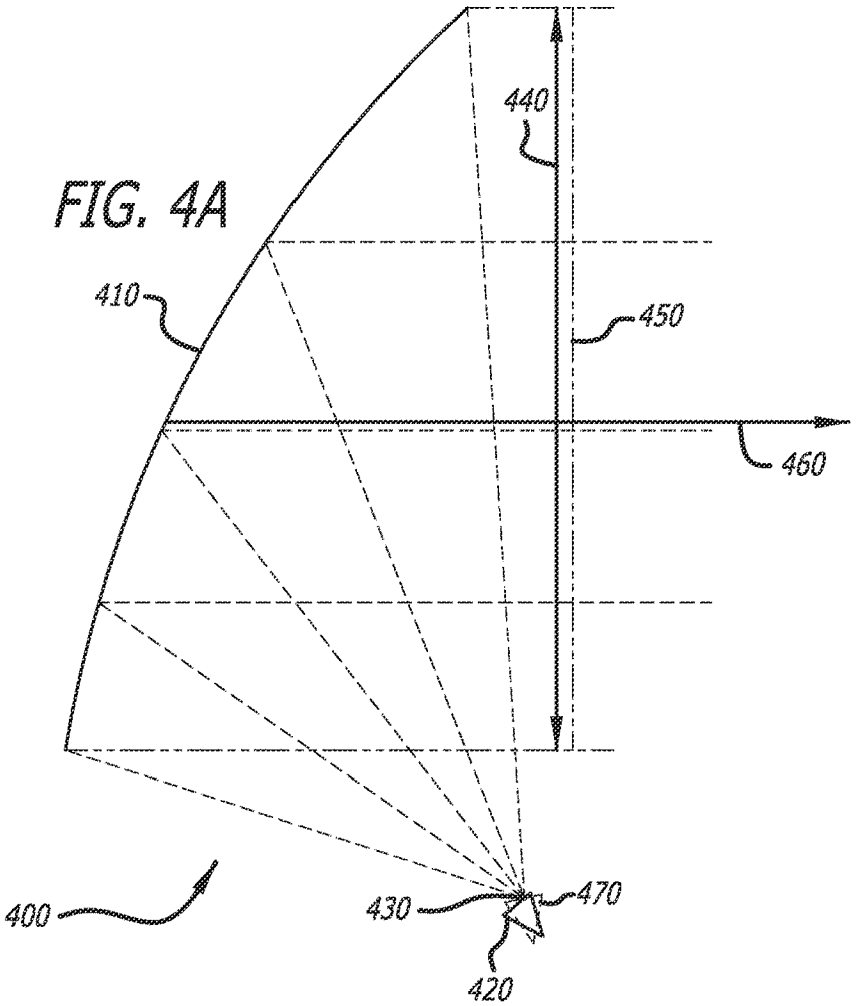
FIG. 4A is a diagram illustrating ray tracing for a parabolic reflector, when the feed is located at the focal point and rotated.

FIG. 4A is a diagram 400 illustrating ray tracing for a parabolic reflector 410, when the feed 420 is located at the focal point 430 and rotated 470. As shown in this figure, for a parabolic reflector 410, all rays from the feed 420 are reflected by the reflector with equal angles, thereby resulting in a uniform phase front 450, which is parallel to the aperture plane 440. In this example, the feed 420 is located at the focal point 430, thereby resulting in a beam in the boresight 460 direction. It should be noted that a feed re-pointing (or rotating) away from the aperture angular center (e.g., refer to rotated feed 470 as shown) will increase spill over and decrease aperture efficiency, but will not shift the resulting beam.

It should be noted that in the present disclosure the feed re-pointing is with respect to the nominal pointing direction of the feed 420, which is typically the direction that minimizes spillover (or equal sub-tended angle direction).

FIG. 4B is a graph showing the beam directivity associated with FIG. 4A. In this figure, the beam directivity pattern for a non-rotated feed 480 and the beam directivity pattern for a rotated feed 490 are both shown to be roughly centered about the zero degrees (0°) axis. The beam directivity pattern for a rotated feed 490 is shown to have less directivity than the beam directivity pattern for a non-rotated feed 480. This is due to an increase in spill over and, thus, a decrease in aperture efficiency.

Figure 5B:
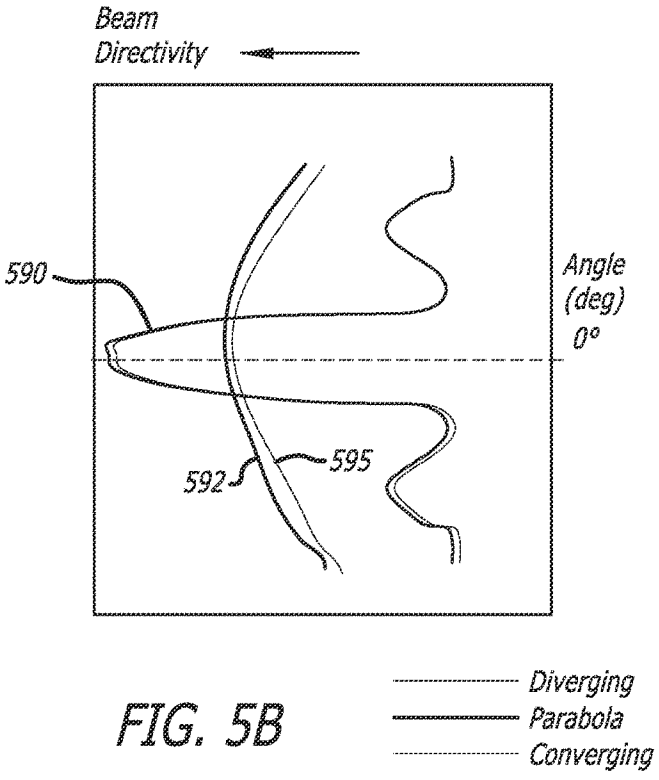
FIG. 5B is a graph showing the beam directivity associated with FIG. 5A.
Figure 5A:
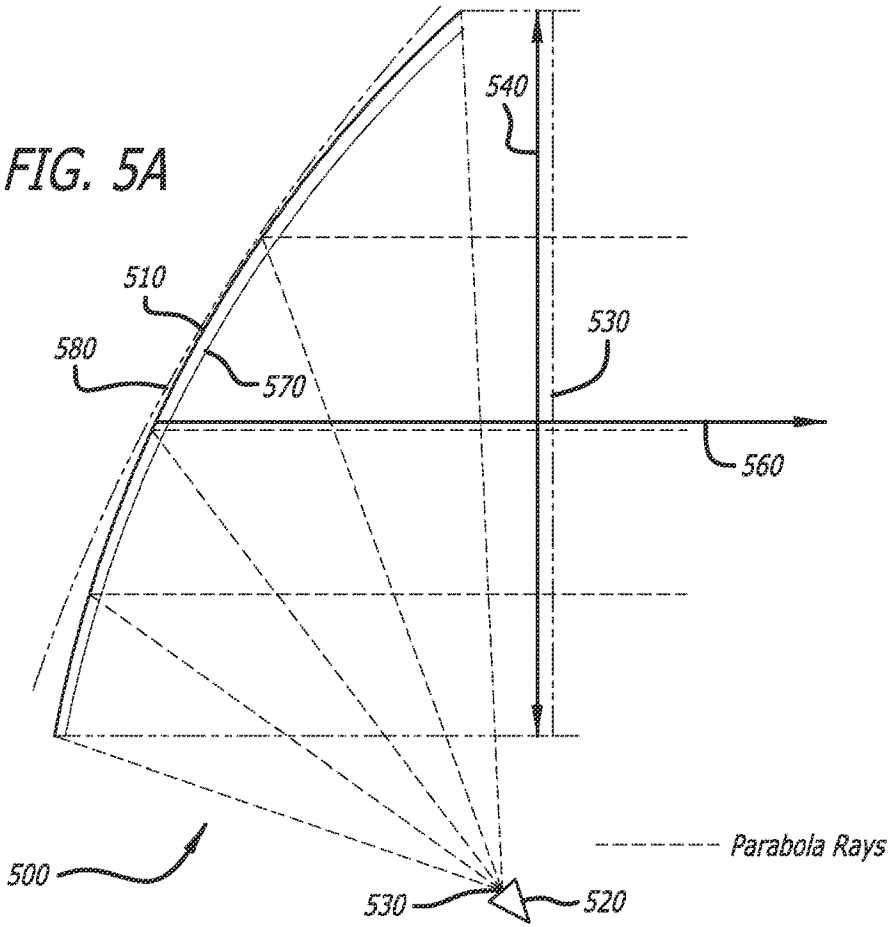
FIG. 5A is a diagram depicting ray tracing for a shaped reflector, when the feed is located at the focal point.

FIG. 5A is a diagram 500 depicting ray tracing for a shaped reflector 510, when the feed 520 is located at the focal point 530. As shown in this figure, by shaping the reflector 510 (either with a converging surface 570 or with a diverging surface 580), a shaped beam can be produced. When shaping the reflector 510, an initial perturbation to the surface called the initial GO (Geometrical Optic) solution is applied to the parabola, resulting in the broadening and flattening of the beam. The initial beam solution must cover the region (i.e. on Earth) to illuminate. The initial shaped surface of the reflector 510 can be diverging (e.g., a diverging surface 580) (i.e. more concave), or converging (e.g., a converging surface 570) (i.e. more convex) compared to a parabolic surface.

As shown in this figure, for a parabolic reflector 510, all rays from the feed 520 are reflected by the reflector with equal angles, thereby resulting in a uniform phase front 550 that is parallel to the aperture plane 540. In this example, the feed 520 is located at the focal point 530, thereby resulting in a beam in the boresight 560 direction.

FIG. 5B is a graph showing the beam directivity associated with FIG. 5A. In this figure, the beam directivity pattern 590 for the parabolic reflector 510, the initial beam directivity pattern 592 for the diverging surface 580, and the initial beam directivity pattern 595 for the converging surface 570 are all shown to be roughly centered about the zero degrees (0°) axis.

Figure 6B:
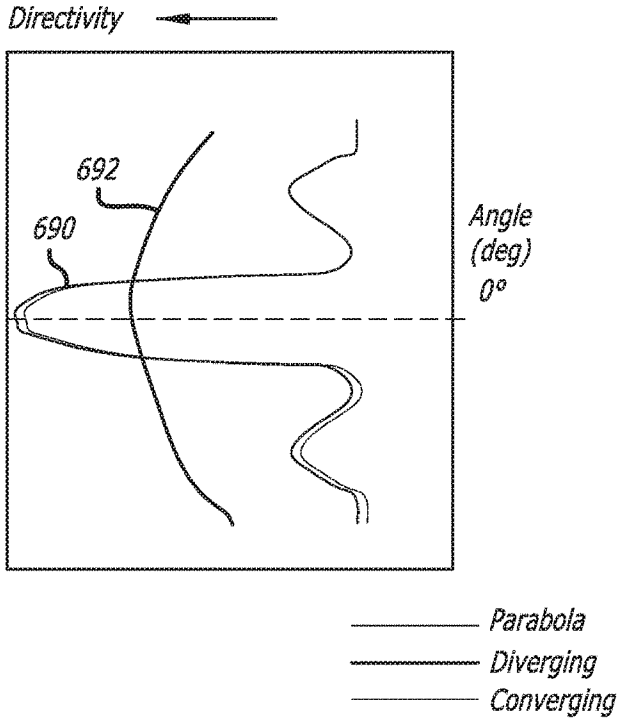
FIG. 6B is a graph showing the beam directivity associated with FIG. 6A.
Figure 6A:
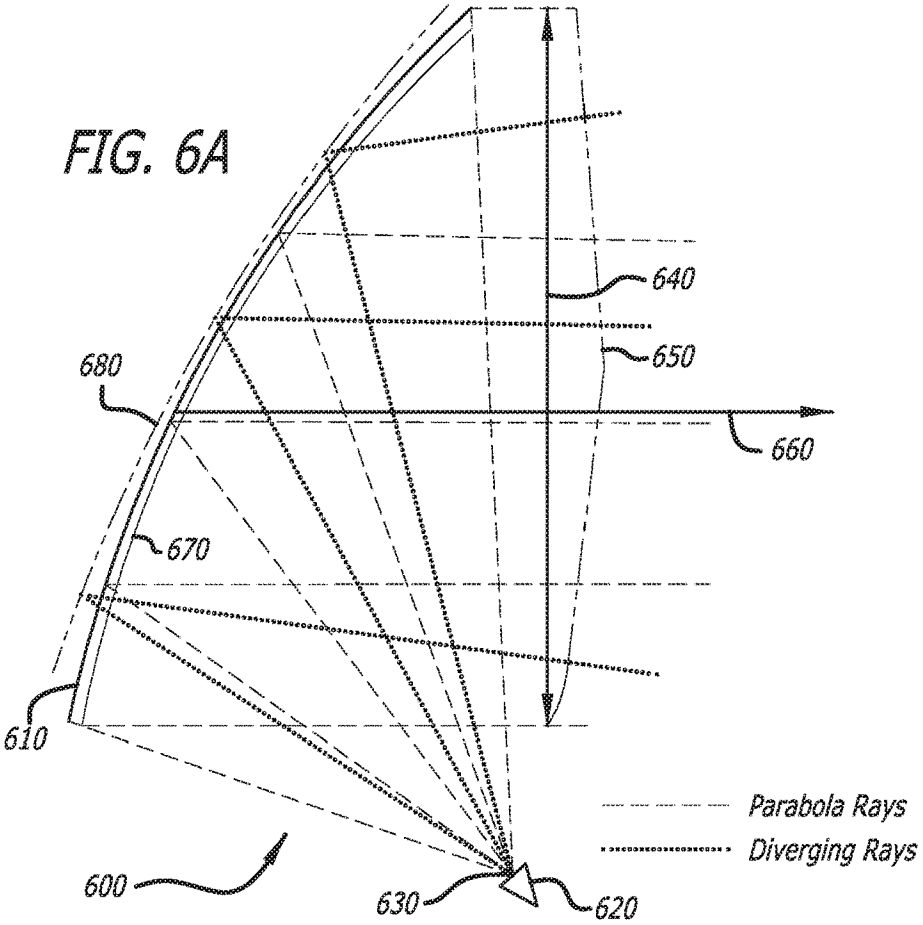
FIG. 6A is a diagram illustrating ray tracing for a diverging reflector, when the feed is located at the focal point.

FIG. 6A is a diagram 600 illustrating ray tracing for a diverging reflector 680 when the feed 620 is located at the focal point 630. In this figure, a diverging reflector 680 (i.e. a reflector with a diverging surface), a converging reflector 670 (i.e. a reflector with a converging surface), a parabolic reflector 610, and the boresight 660 direction are shown. Also in this figure, it is shown that the rays reflected from the diverging reflector 680 are non-parallel to each other, and result in a non-uniform phase front 650. Since the phase front is non-uniform 650, it is not parallel to the aperture plane 640.

FIG. 6B is a graph showing the beam directivity associated with FIG. 6A. In this figure, the beam directivity pattern 690 for the parabolic reflector 510 and the initial beam directivity pattern 692 for the diverging surface 580 are shown to be roughly centered about the zero degrees (0°) axis.

Figure 7B:
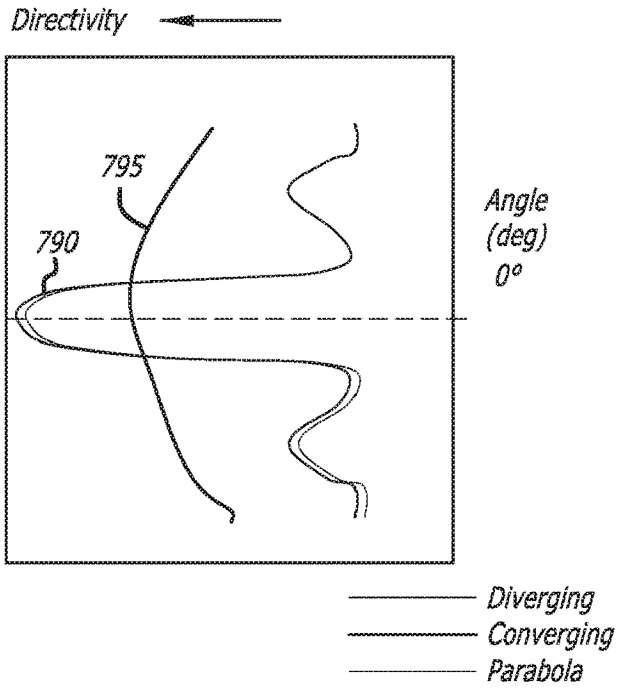
Figure 7A:
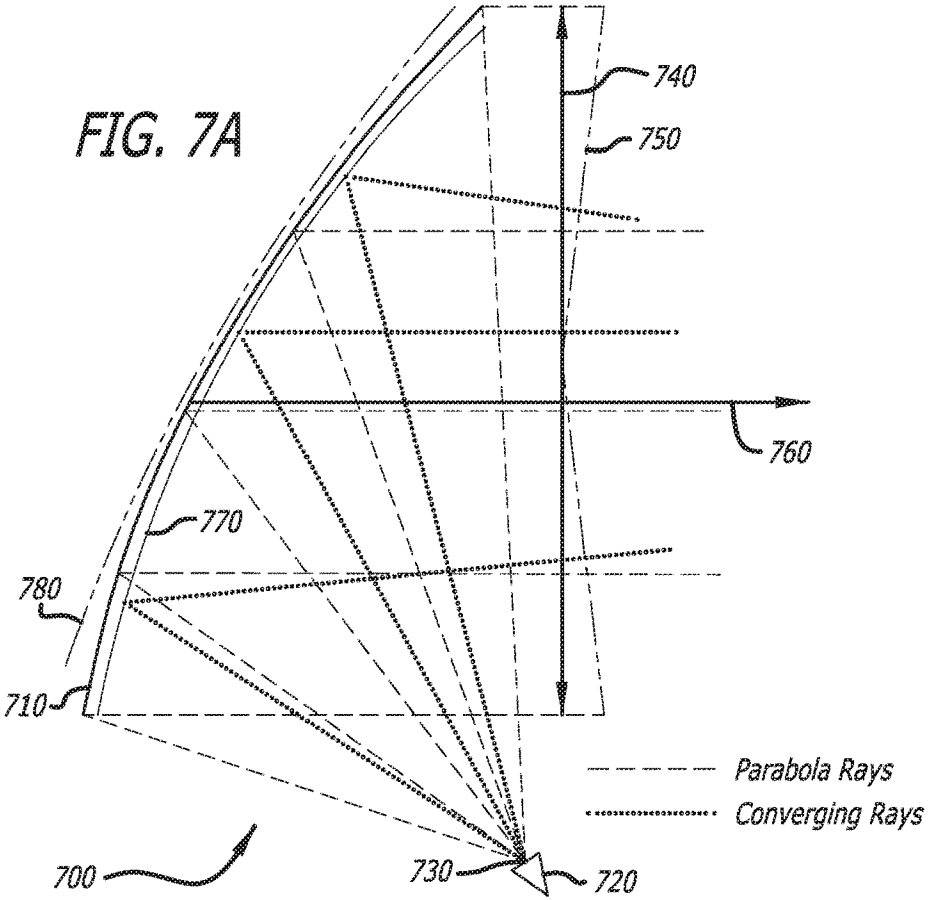
FIG. 7A is a diagram illustrating ray tracing for a converging reflector, when the feed is located at the focal point.

FIG. 7A is a diagram 700 illustrating ray tracing for a converging reflector 770, when the feed 720 is located at the focal point 730. In this figure, a diverging reflector 780 (i.e. a reflector with a diverging surface), a converging reflector 770 (i.e. a reflector with a converging surface), a parabolic reflector 710, and the boresight 760 direction are shown. Also in this figure, it is shown that the rays reflected from the converging reflector 770 are non-parallel to each other, and result in a non-uniform phase front 750. Since the phase front is non-uniform 750, it is not parallel to the aperture plane 740.

FIG. 7B is a graph showing the beam directivity associated with FIG. 7A. In this figure, the beam directivity pattern 790 for the parabolic reflector 710 and the initial beam directivity pattern 795 for the converging surface 770 are shown to be roughly centered about the zero degrees (0°) axis.

FIGS. 8A-16 illustrate the disclosed system and method for feed re-pointing for multiple shaped beams reflector antennas, in accordance with multiple embodiments of the present disclosure.

Figure 8A:
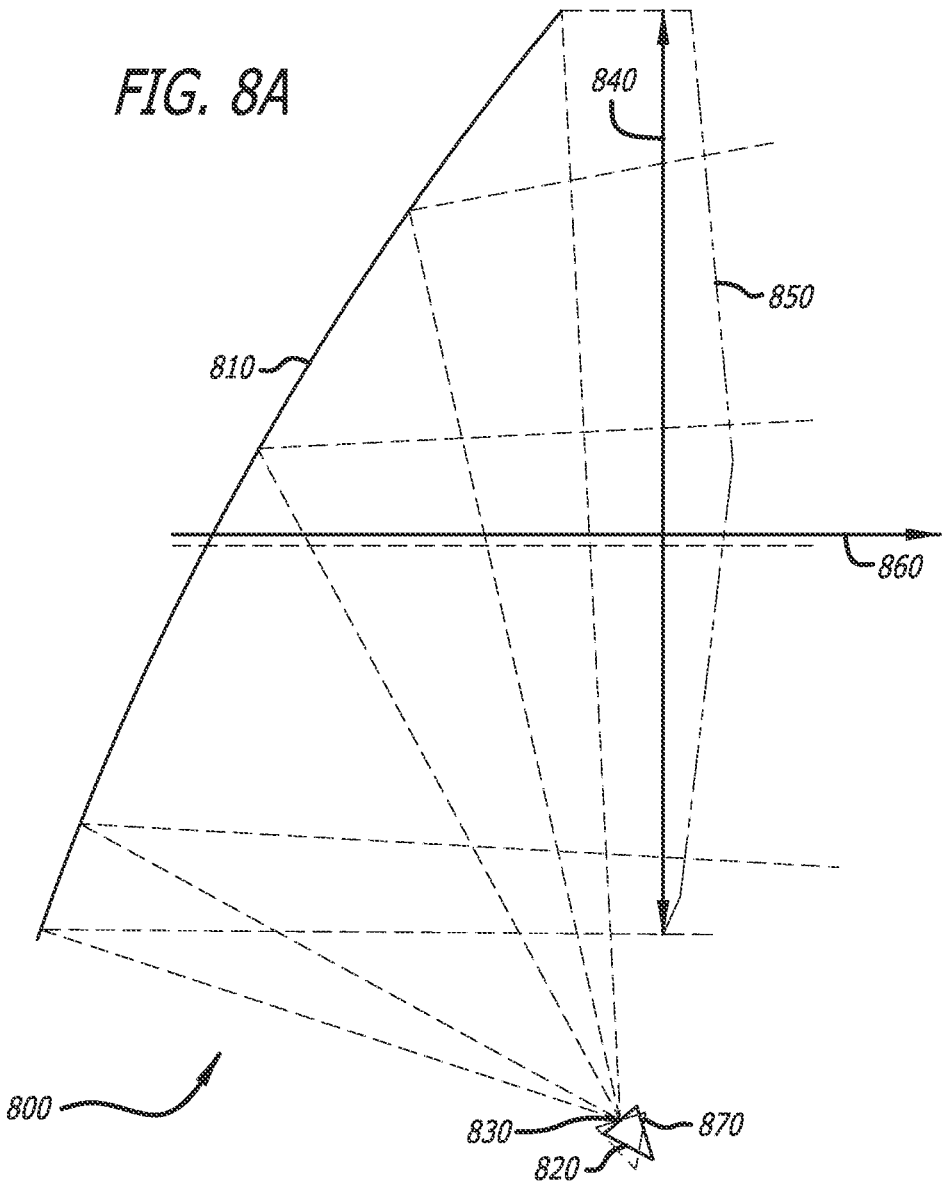

FIG. 8A is a diagram 800 illustrating ray tracing for diverging reflector 810, when the feed 820 is located at the focal point 830 and rotated 870, in accordance with at least one embodiment of the present disclosure. In this figure, a diverging reflector 810 (i.e. a reflector with a diverging surface) and the boresight 860 direction are shown. Also in this figure, it is shown that the rays reflected from the diverging reflector 810 are non-parallel to each other, and result in a non-uniform phase front 850. Since the phase front is non-uniform 850, it is not parallel to the aperture plane 840.

As shown in this figure, for a shaped surface (e.g., a diverging reflector 810), due to the non-uniformity of the phase distribution over the reflector aperture (i.e. a non-uniform phase front 850), re-pointing 870 the feed 820 to a specific area of the reflector 810 increases power in that area, and results in a beam shift determined by the direction of the local phase front in that area.

Figure 8B:
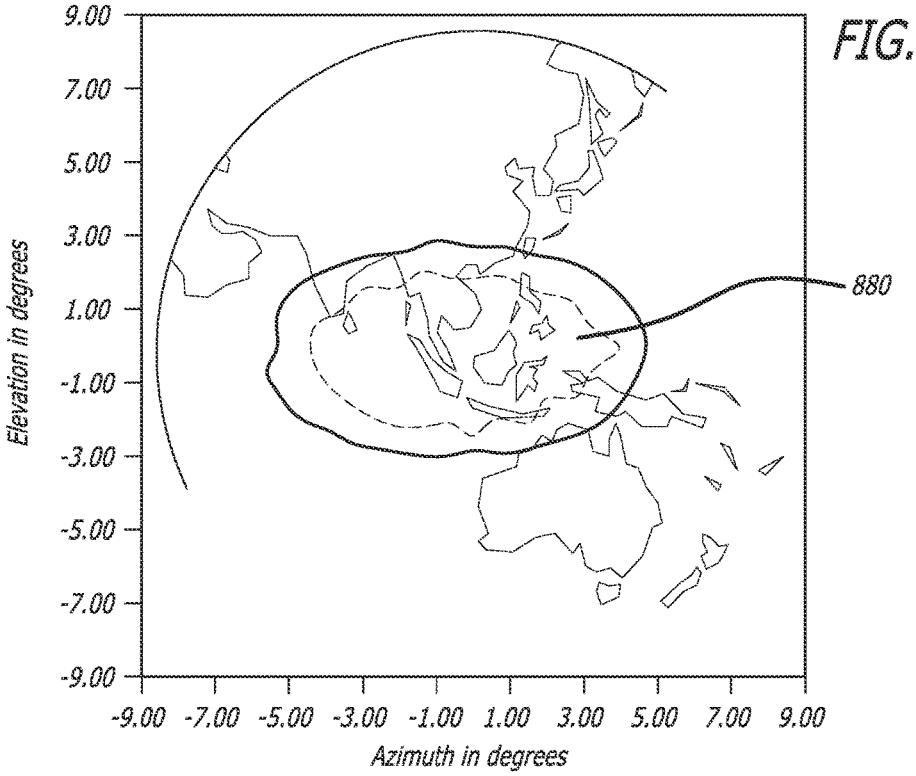
FIG. 8B is a graph showing an exemplary antenna pattern on Earth associated with the diverging reflector with the feed located at the focal point of FIG. 8A, in accordance with at least one embodiment of the present disclosure.

FIG. 8B is a graph showing an exemplary antenna pattern 880 on Earth associated with the diverging reflector 810 with the feed 820 located at the focal point 830 of FIG. 8A, in accordance with at least one embodiment of the present disclosure. In this figure, the antenna pattern 880 (i.e. beam) is shown to be located over North America.

Figure 8C:
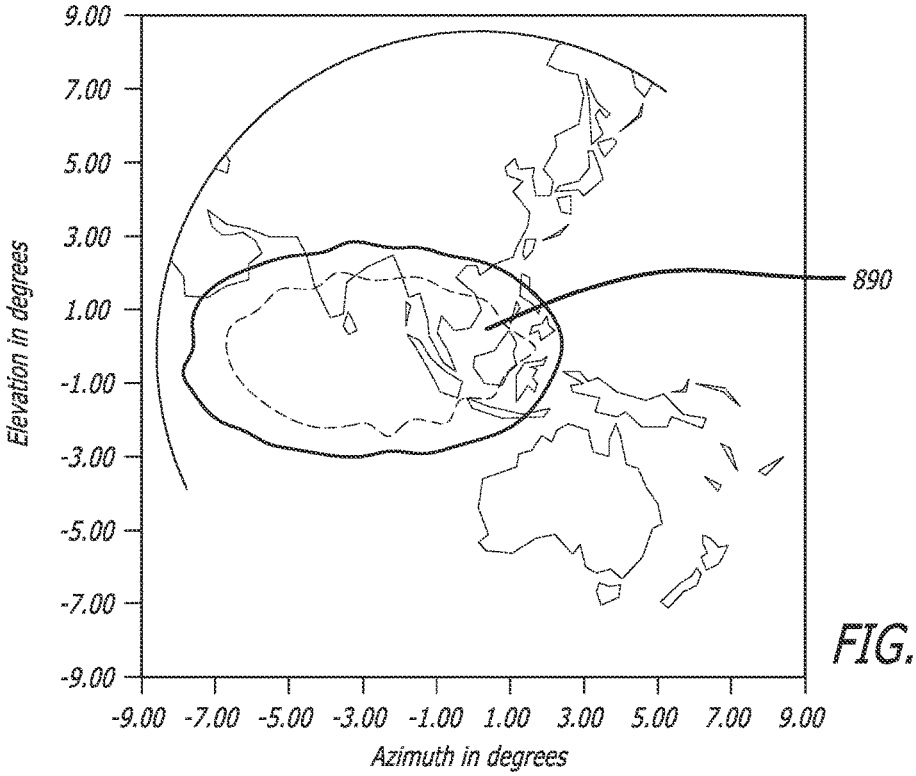
FIG. 8C is a graph showing an exemplary antenna pattern on Earth associated with the diverging reflector with the feed located at the focal point and rotated of FIG. 8A, in accordance with at least one embodiment of the present disclosure.

FIG. 8C is a graph showing an exemplary antenna pattern 890 on Earth associated with the diverging reflector 810 with the feed 820 located at the focal point 830 and rotated 870 of FIG. 8A, in accordance with at least one embodiment of the present disclosure. In this figure, the antenna pattern 890 (i.e. beam) is shown to be shifted to the west of North America, partially into the Pacific Ocean. The feed 820 re-pointed 870 four degrees (4°) in the Azimuth plane.

Figure 9B:
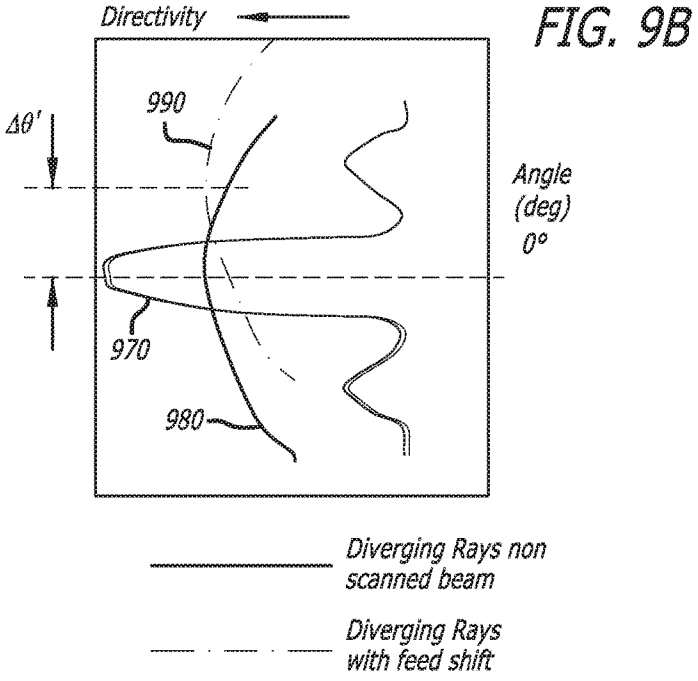
FIG. 9B is a graph showing the beam directivity associated with FIG. 9A, in accordance with at least one embodiment of the present disclosure.
Figure 9A:
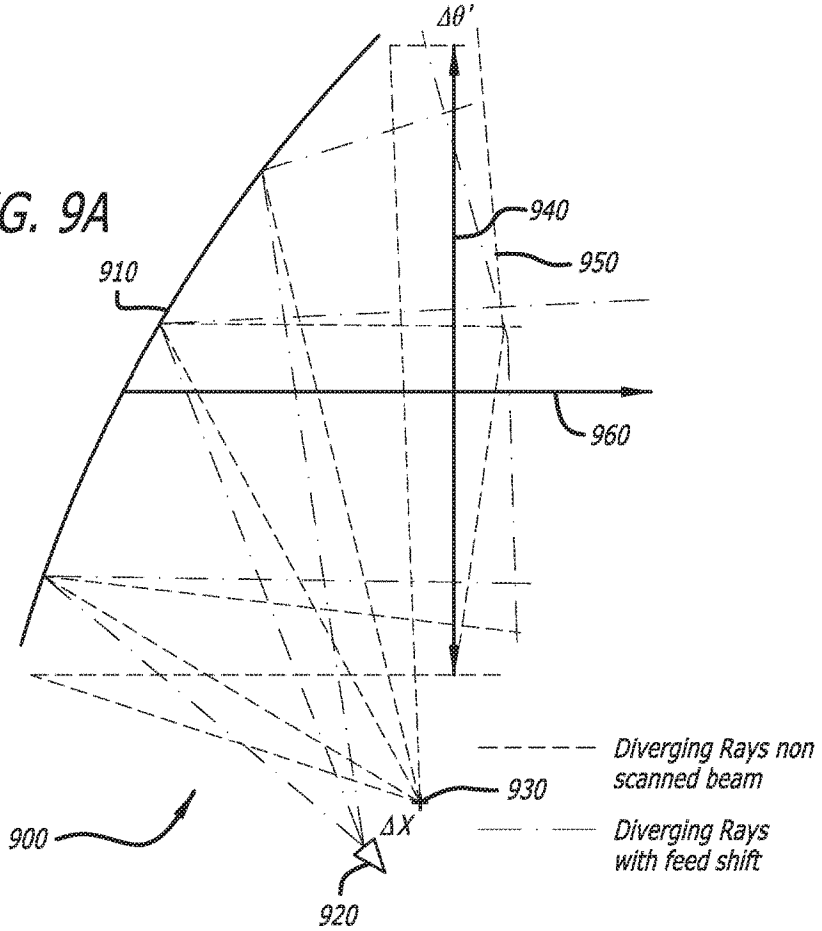
FIG. 9A is a diagram illustrating ray tracing for diverging reflector, when the feed is translated in a down direction away from the focal point, in accordance with at least one embodiment of the present disclosure.

FIG. 9A is a diagram 900 illustrating ray tracing for diverging reflector 910, when the feed 920 is translated in a down direction away from the focal point 930, in accordance with at least one embodiment of the present disclosure. In this figure, a diverging reflector 910 (i.e. a reflector with a diverging surface) and the boresight 960 direction are shown. Also in this figure, it is shown that the rays reflected from the diverging reflector 910 are non-parallel to each other, and result in a non-uniform phase front 950. Since the phase front is non-uniform 950, it is not parallel to the aperture plane 940.

As shown in this figure, when the feed 920 is translated a distance $\Delta x$ away from the focal point 930 as shown, the non-uniform phase front 950 is shifted by $\Delta\Theta'$, thereby resulting in a beam shifted in the up direction.

FIG. 9B is a graph showing the beam directivity associated with FIG. 9A, in accordance with at least one embodiment of the present disclosure. In this figure, the beam directivity pattern 970 for a parabolic reflector and the initial beam directivity pattern 980 for the diverging surface 910 with the feed 920 located at the focal point 930, are both shown to be roughly centered about the zero degrees (0°) axis. Also, in this figure, the initial beam directivity pattern 990, for the diverging surface 910 with the feed 920 translated at a distance Δx away from the focal point 930, is shown to be shifted by ΔΘ' in an up direction.

Figure 10B:
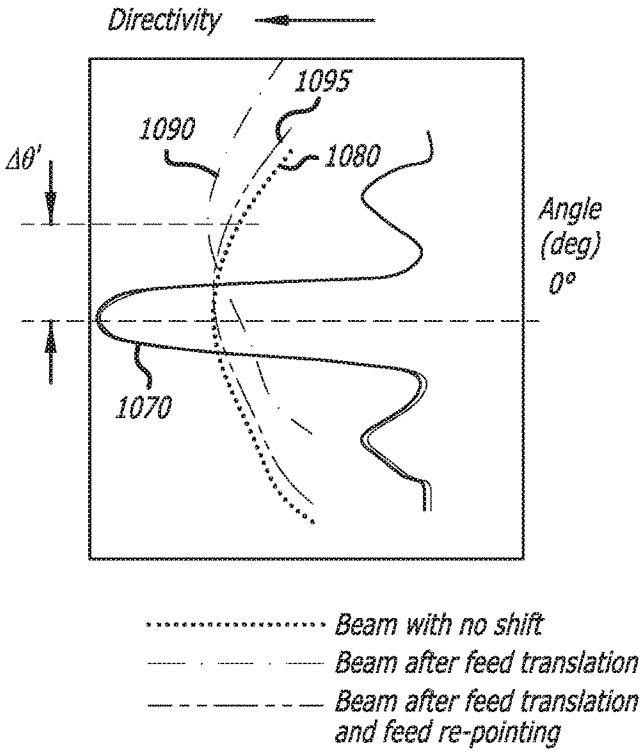
FIG. 10B is a graph showing the beam directivity associated with FIG. 10A, in accordance with at least one embodiment of the present disclosure.
Figure 10A:
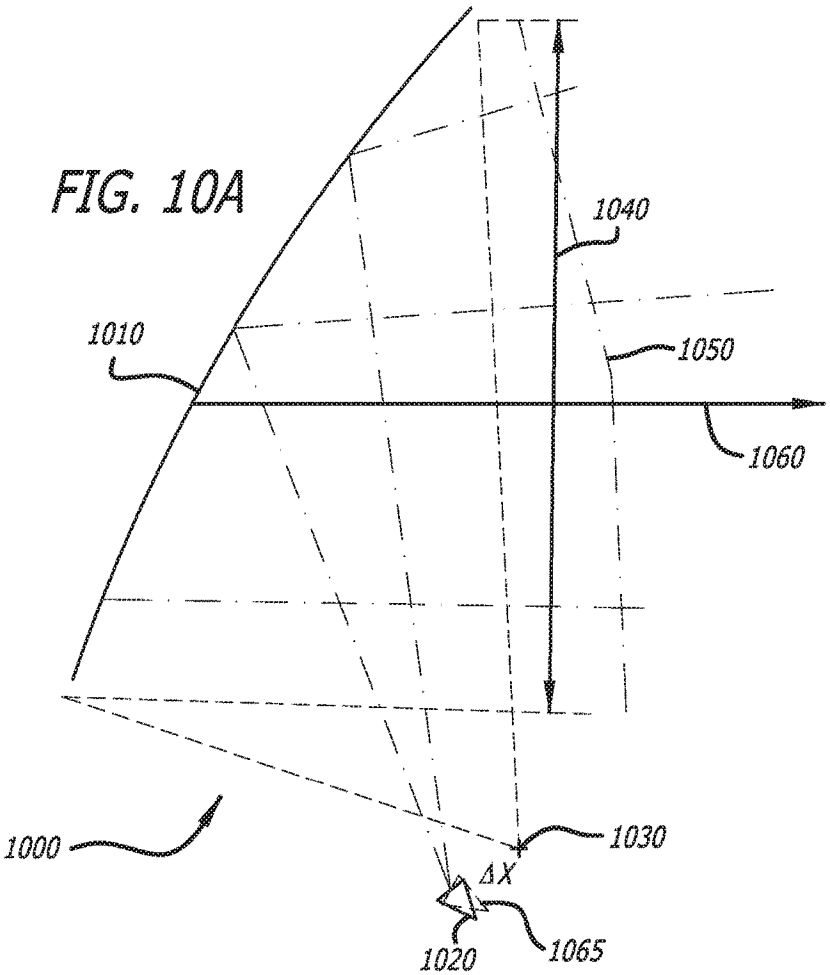
FIG. 10A is a diagram illustrating ray tracing for diverging reflector, when the feed is translated in a down direction away from the focal point and rotated in a down direction, in accordance with at least one embodiment of the present disclosure.

FIG. 10A is a diagram 1000 illustrating ray tracing for diverging reflector 1010, when the feed 1020 is translated in a down direction away from the focal point 1030 and rotated 1065 in a down direction, in accordance with at least one embodiment of the present disclosure. In this figure, a diverging reflector 1010 (i.e. a reflector with a diverging surface) and the boresight 1060 direction are shown. Also in this figure, it is shown that the rays reflected from the diverging reflector 1010 are non-parallel to each other, and result in a non-uniform phase front 1050. Since the phase front is non-uniform 1050, it is not parallel to the aperture plane 1040.

As shown in this figure, translating the feed 1020 by a distance Δx away from the focal point 1030 in the direction as shown, results in a beam shift in an up direction. Also, as shown, rotating 1065 the feed 1020 towards the lower part of the reflector 1010, shifts the power towards the lower part of the reflector 1010, and produces a beam shift in a down direction.

FIG. 10B is a graph showing the beam directivity associated with FIG. 10A, in accordance with at least one embodiment of the present disclosure. In this figure, the beam directivity pattern 1070 for a parabolic reflector and the initial beam directivity pattern 1080, for the diverging surface 1010 with the feed 1020 located at the focal point 1030, are both shown to be roughly centered about the zero degrees (0°) axis. Also, in this figure, the initial beam directivity pattern 1090, for the diverging surface 1010 with the feed 1020 translated at a distance Δx away from the focal point 1030, is shown to be shifted by ΔΘ' in an up direction. Additionally, in this figure, the initial beam directivity pattern 1095, for the diverging surface 1010 with the feed 1020 translated at a distance Δx away from the focal point 1030 and re-pointed (or rotated) 1065, is shown to be shifted by ΔΘ' in a down direction.

Figure 11B:
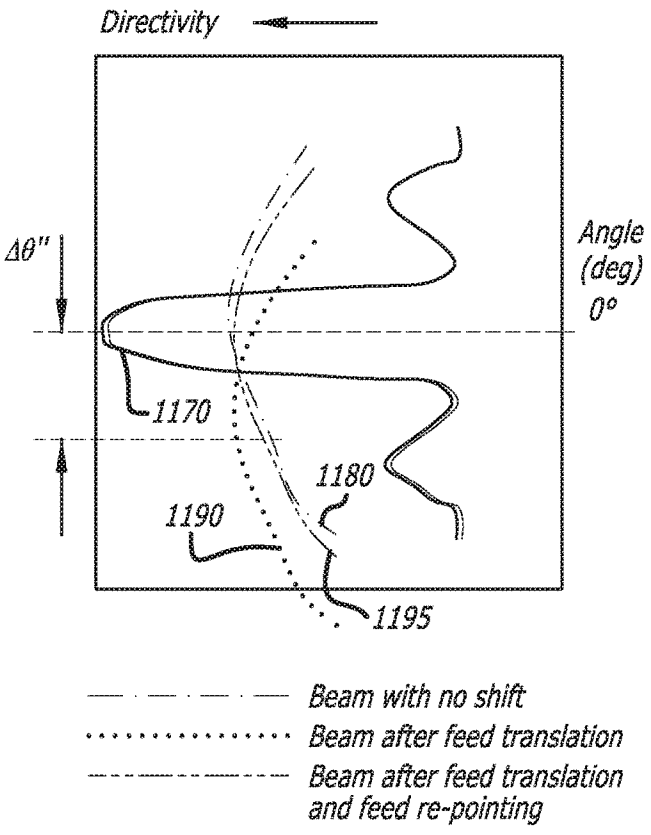
FIG. 11B is a graph showing the beam directivity associated with FIG. 11A, in accordance with at least one embodiment of the present disclosure.
Figure 11A:
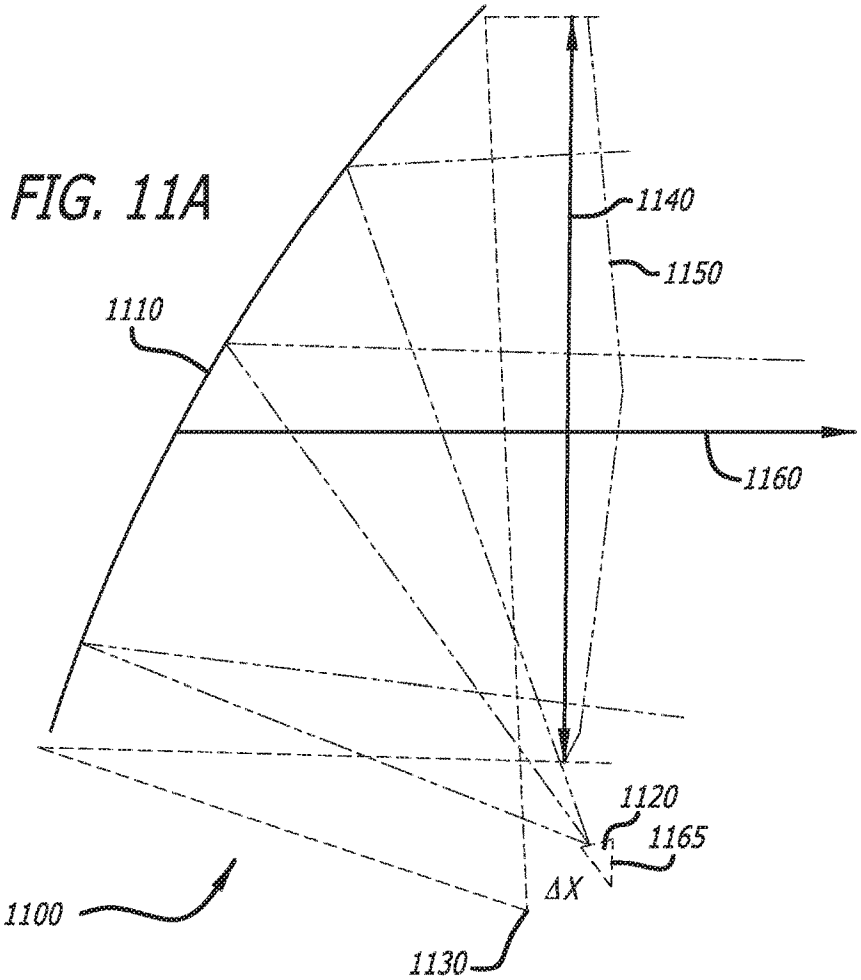
FIG. 11A is a diagram illustrating ray tracing for diverging reflector, when the feed is translated in an up direction away from the focal point and rotated in an up direction, in accordance with at least one embodiment of the present disclosure.

FIG. 11A is a diagram 1100 illustrating ray tracing for diverging reflector 1110, when the feed 1120 is translated in an up direction away from the focal point 1130 and rotated 1165 in an up direction, in accordance with at least one embodiment of the present disclosure. In this figure, a diverging reflector 1110 (i.e. a reflector with a diverging surface) and the boresight 1160 direction are shown. Also in this figure, it is shown that the rays reflected from the diverging reflector 1110 are non-parallel to each other, and result in a non-uniform phase front 1150. Since the phase front is non-uniform 1050, it is not parallel to the aperture plane 1140.

As shown in this figure, translating the feed 1120 by a distance Δx away from the focal point 1130 in the direction as shown, results in a beam shift in a down direction. Also, as shown, rotating 1165 the feed 1120 towards the upper part of the reflector 1110, shifts the power towards the upper part of the reflector 1110, and produces a beam shift in an up direction.

FIG. 11B is a graph showing the beam directivity associated with FIG. 11A, in accordance with at least one embodiment of the present disclosure. In this figure, the beam directivity pattern 1170 for a parabolic reflector and the initial beam directivity pattern 1180, for the diverging surface 1110 with the feed 1120 located at the focal point 1130, are both shown to be roughly centered about the zero degrees (0°) axis. Also, in this figure, the initial beam directivity pattern 1190, for the diverging surface 1110 with the feed 1120 translated at a distance Δx away from the focal point 1130, is shown to be shifted by ΔΘ' in an down direction. Additionally, in this figure, the initial beam directivity pattern 1195, for the diverging surface 1110 with the feed 1120 translated at a distance Δx away from the focal point 1130 and re-pointed (or rotated) 1165, is shown to be shifted by ΔΘ" in a up direction.

Figure 12B:
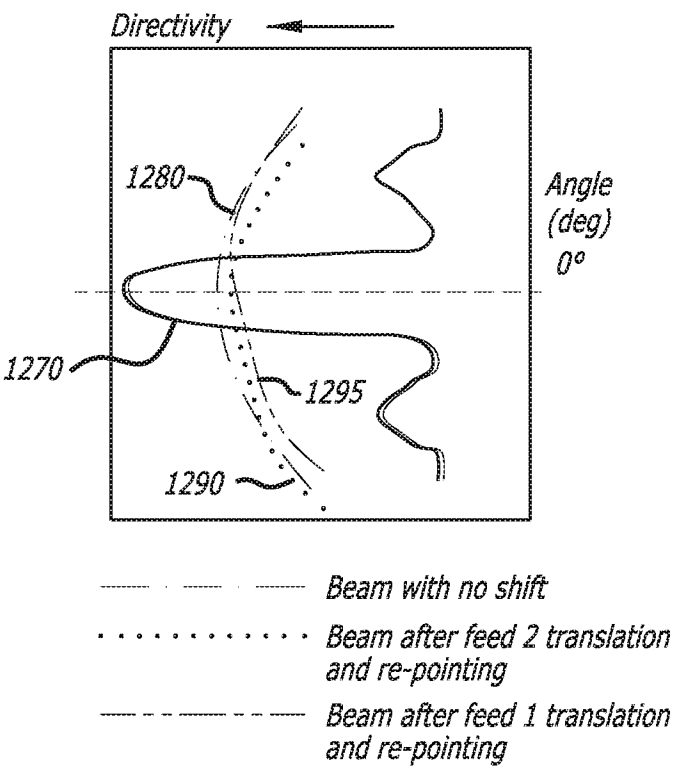
FIG. 12B is a graph showing the beam directivity associated with FIG. 12A, in accordance with at least one embodiment of the present disclosure.
Figure 12A:
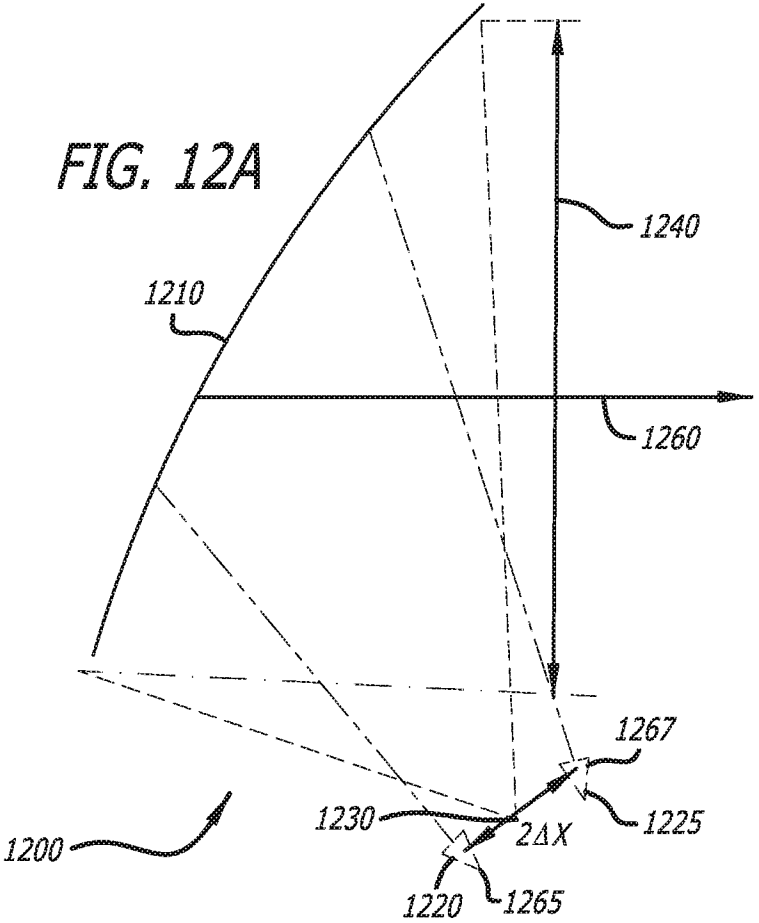
FIG. 12A is a diagram illustrating ray tracing for diverging reflector, when a first feed (Feed 1) is translated in a down direction away from the focal point and rotated in a down direction, and a second feed (Feed 2) is translated in an up direction away from the focal point and rotated in an up direction, in accordance with at least one embodiment of the present disclosure.

FIG. 12A is a diagram 1200 illustrating ray tracing for diverging reflector 1210, when a first feed (Feed 1) 1220 is translated in a down direction away from the focal point 1230 and rotated 1265 in a down direction, and a second feed (Feed 2) 1225 is translated in an up direction away from the focal point 1230 and rotated 1267 in an up direction, in accordance with at least one embodiment of the present disclosure. In this figure, a diverging reflector 1210 (i.e. a reflector with a diverging surface), the aperture plane 1240, and the boresight 1260 direction are shown.

As shown in this figure, the re-pointing (i.e. rotating) 1265, 1267 of the two feeds 1220, 1225 allows for the two beams to be overlapped, while avoiding feed interference. It should be noted that, as shown in this example in this figure, the feeds 1220, 1225, when pointing away from each other, are referred to as "diverging feeds".

FIG. 12B is a graph showing the beam directivity associated with FIG. 12A, in accordance with at least one embodiment of the present disclosure. In this figure, the beam directivity pattern 1270 for a parabolic reflector and the initial beam directivity pattern 1280, for the diverging surface 1210 with the feed 1220 (Feed 1) located at the focal point 1230, are both shown to be roughly centered about the zero degrees (0°) axis. Also, in this figure, the initial beam directivity pattern 1290, for the diverging surface 1210 with the feed 1225 (Feed 2) translated at a distance Δx away from the focal point 1230 and re-pointed (or rotated) 1267, is shown to be roughly centered about the zero degrees (0°) axis. Additionally, in this figure, the initial beam directivity pattern 1295, for the diverging surface 1210 with the feed 1220 (Feed 1) translated at a distance Δx away from the focal point 1230 and re-pointed (or rotated) 1265, is shown to be roughly centered about the zero degrees (0°) axis.

It should be noted that in this example, only two feeds 1220, 1225 are shown to be re-pointed. However, it should be noted that in other embodiments of the present disclosure, more than two feeds may be re-pointed (i.e. the re-pointing method may be used for one or more beams).

Figure 13B:
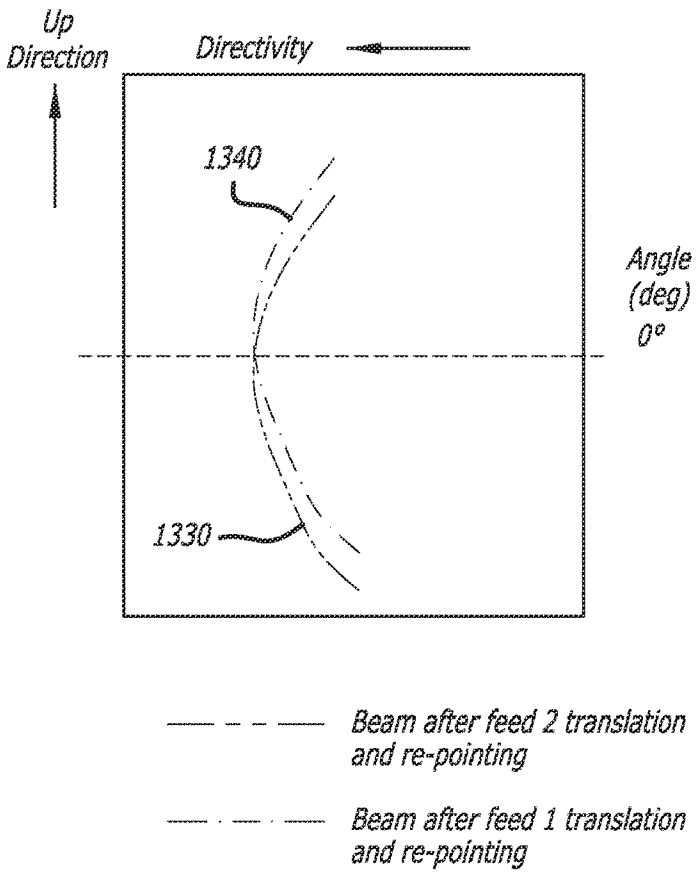
FIG. 13B is a graph showing the beam directivity associated with FIG. 12A, when the second feed (Feed 2) is translated in an up direction away from the focal point and rotated in an up direction, and when the first feed (Feed 1) is translated in a down direction away from the focal point and rotated in a down direction, in accordance with at least one embodiment of the present disclosure.
Figure 13A:
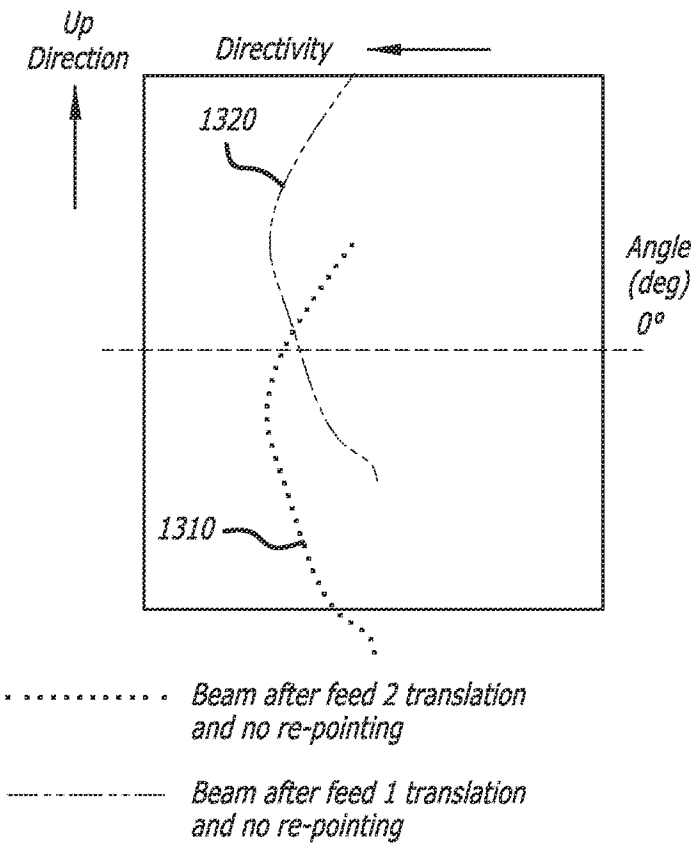
FIG. 13A is a graph showing the beam directivity associated with FIG. 12A, when the second feed (Feed 2) is translated in an up direction away from the focal point, and when the first feed (Feed 1) is translated in a down direction away from the focal point, in accordance with at least one embodiment of the present disclosure.

FIG. 13A is a graph showing the beam directivity associated with FIG. 12A, when the second feed 1225 (Feed 2) is translated in an up direction away from the focal point 1230, and when the first feed 1220 (Feed 1) is translated in a down direction away from the focal point 1230, in accordance with at least one embodiment of the present disclosure. In this figure, the initial beam directivity pattern 1310, for the diverging surface 1210 with the feed 1220 (Feed 1) translated at a distance Δx away from the focal point 1230, is shown to be shifted in a down direction. Also, in this figure, the initial beam directivity pattern 1320, for the diverging surface 1210 with the feed 1225 (Feed 2) translated at a distance Δx away from the focal point 1230, is shown to be shifted in an up direction.

FIG. 13B is a graph showing the beam directivity associated with FIG. 12A, when the second feed 1225 (Feed 2) is translated in an up direction away from the focal point 1230 and rotated 1267 in an up direction, and when the first feed 1220 (Feed 1) is translated in a down direction away from the focal point 1230 and rotated 1265 in a down direction, in accordance with at least one embodiment of the present disclosure. In this figure, the initial beam directivity pattern 1330, for the diverging surface 1210 with the feed 1220 (Feed 1) translated at a distance Δx away from the focal point 1230 and rotated 1265, is shown to be roughly centered about the zero degrees (0°) axis. Also, in this figure, the initial beam directivity pattern 1340, for the diverging surface 1210 with the feed 1225 (Feed 2) translated at a distance Δx away from the focal point 1230 and rotated 1267, is shown to be roughly centered about the zero degrees (0°) axis.

Figure 14:
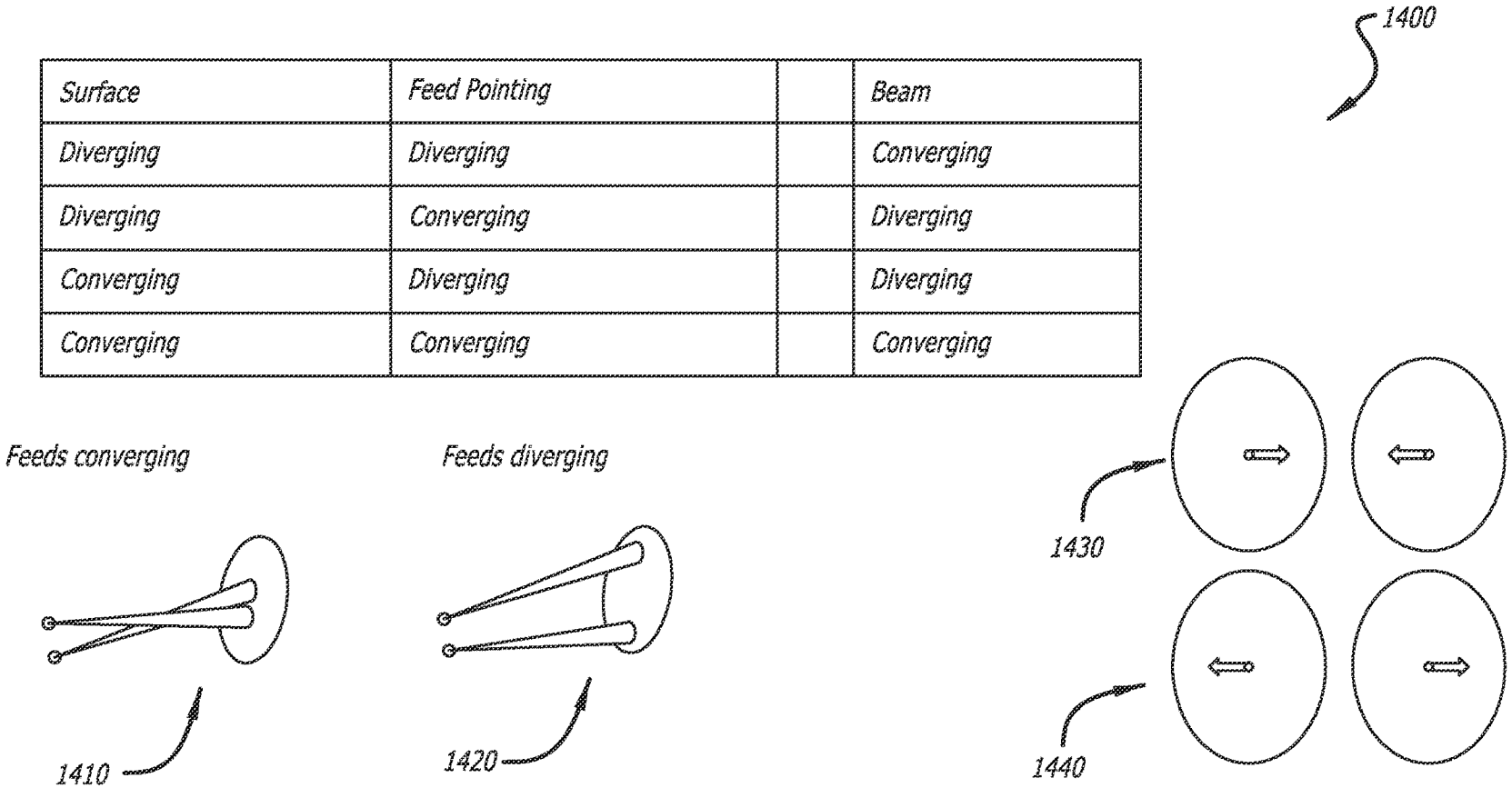

FIG. 14 shows a table 1400 and associated beam diagrams 1410, 1420, 1430, 1440 for feed re-pointing versus beam shifting, in accordance with at least one embodiment of the present disclosure. This table 1400 shows that resultant beam (i.e. either converging or diverging) to be expected for a given surface type (i.e. converging or diverging) and given feed pointing (i.e. diverging and converging). For example, from the table 1400 referring to the first row, when using a diverging surface with a diverging feed pointing, the resulting beam will be converging. With the use of the information from this table 1400, feed re-pointing can be used advantageously to orient the geometrical optics (GO) starting solution of the beams at the right location, while maintaining feeds at locations that can be packaged.

Diagram 1410 is an illustrating showing feeds converging, where the feeds are pointed towards one another, and diagram 1420 is an illustration showing feeds diverging, where the feeds are pointed away from one another. Diagram 1430 shows the resultant initial solution of beams converging, and diagram 1440 shows the resultant initial solution of beams diverging.

Figure 15A:
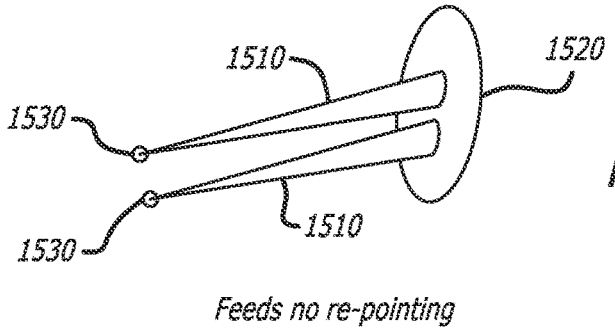
FIG. 15A is a diagram showing the direction of beams formed with a diverging reflector with two feeds, which have no re-pointing or translation, in accordance with at least one embodiment of the present disclosure.
Figure 15B:
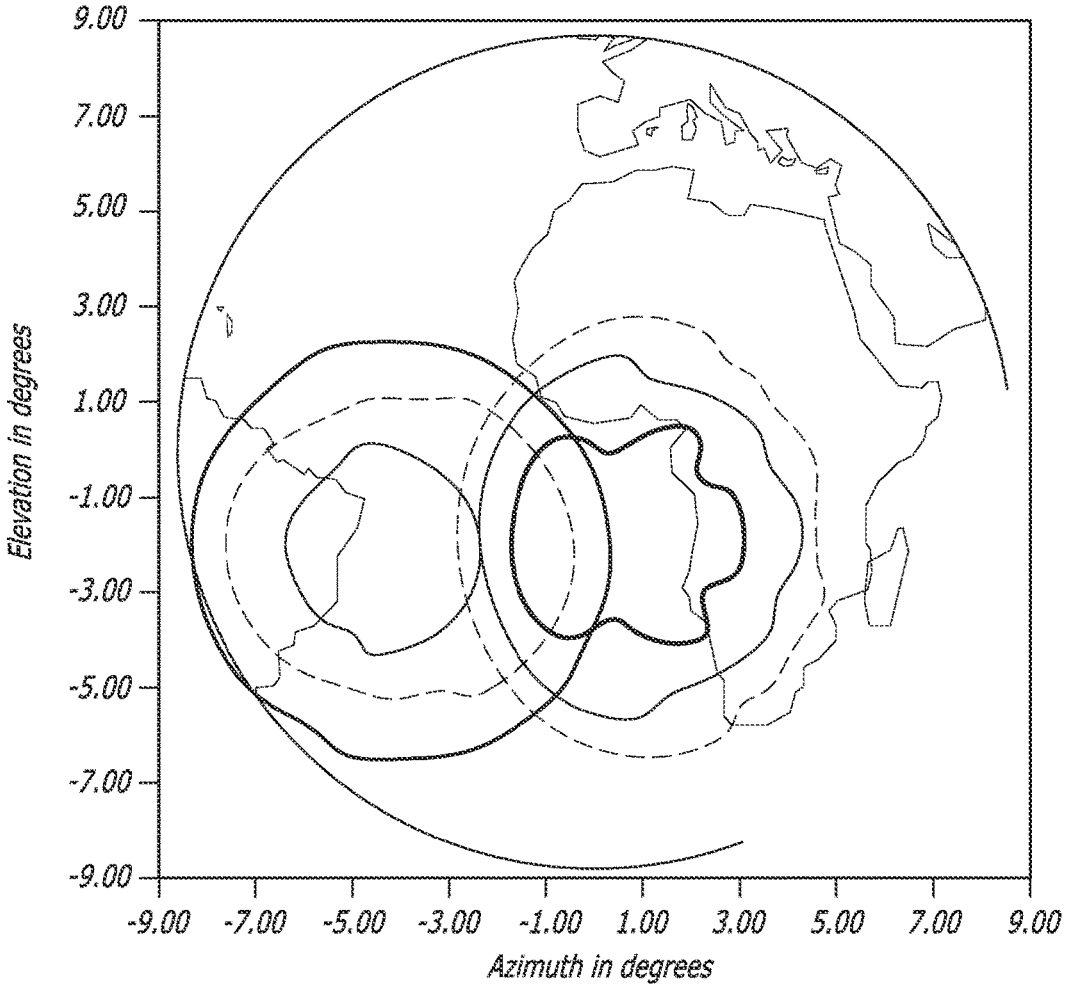
FIG. 15B is a graph showing exemplary antenna patterns on Earth for the beams of FIG. 15A.

FIG. 15A is a diagram showing the direction of beams 1510 formed with a diverging reflector 1520 with two feeds 1530, which have no re-pointing or translation, in accordance with at least one embodiment of the present disclosure. FIG. 15B is a graph showing exemplary antenna patterns (i.e. beams nominal) on Earth for the beams 1510 of FIG. 15A.

Figure 15C:
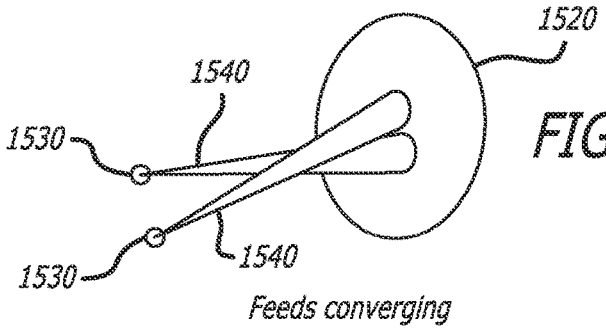
FIG. 15C is a diagram showing the direction of beams formed with a diverging reflector with two feeds, which are rotated in a converging configuration, in accordance with at least one embodiment of the present disclosure.
Figure 15D:
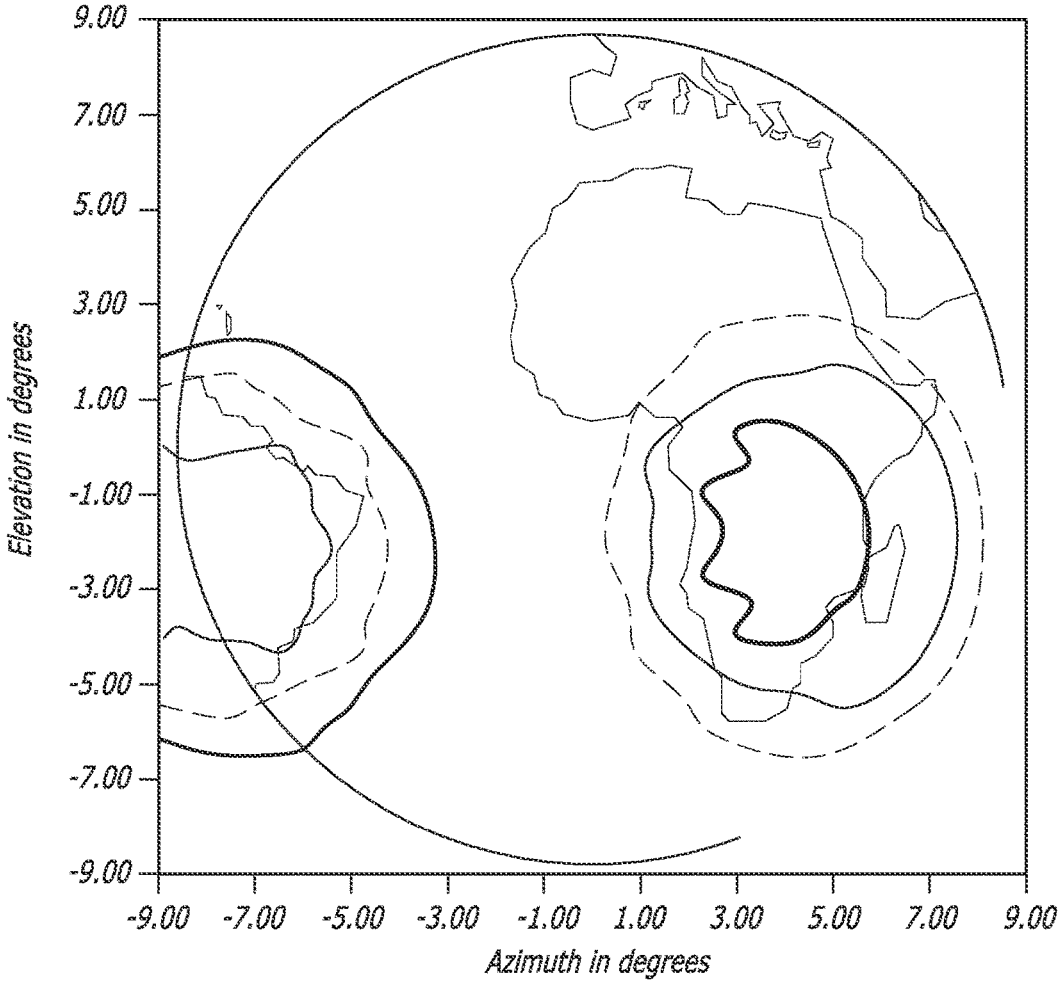
FIG. 15D is a graph showing exemplary antenna patterns on Earth for the beams of FIG. 15C.

FIG. 15C is a diagram showing the direction of beams 1540 formed with a diverging reflector 1520 with two feeds 1530, which are rotated in a converging configuration, in accordance with at least one embodiment of the present disclosure. FIG. 15D is a graph showing exemplary antenna patterns on Earth for the beams 1540 of FIG. 15C.

Figure 15E:
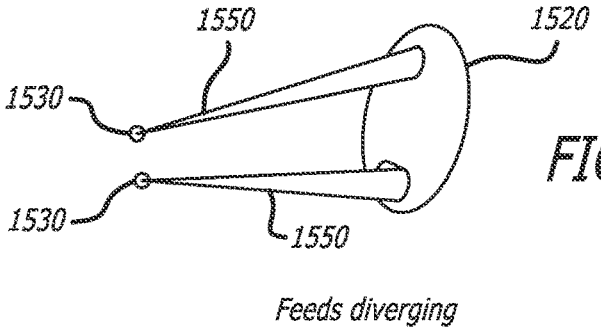
FIG. 15E is a diagram showing the direction of beams formed with a diverging reflector with two feeds, which are rotated in a diverging configuration, in accordance with at least one embodiment of the present disclosure.
Figure 15F:
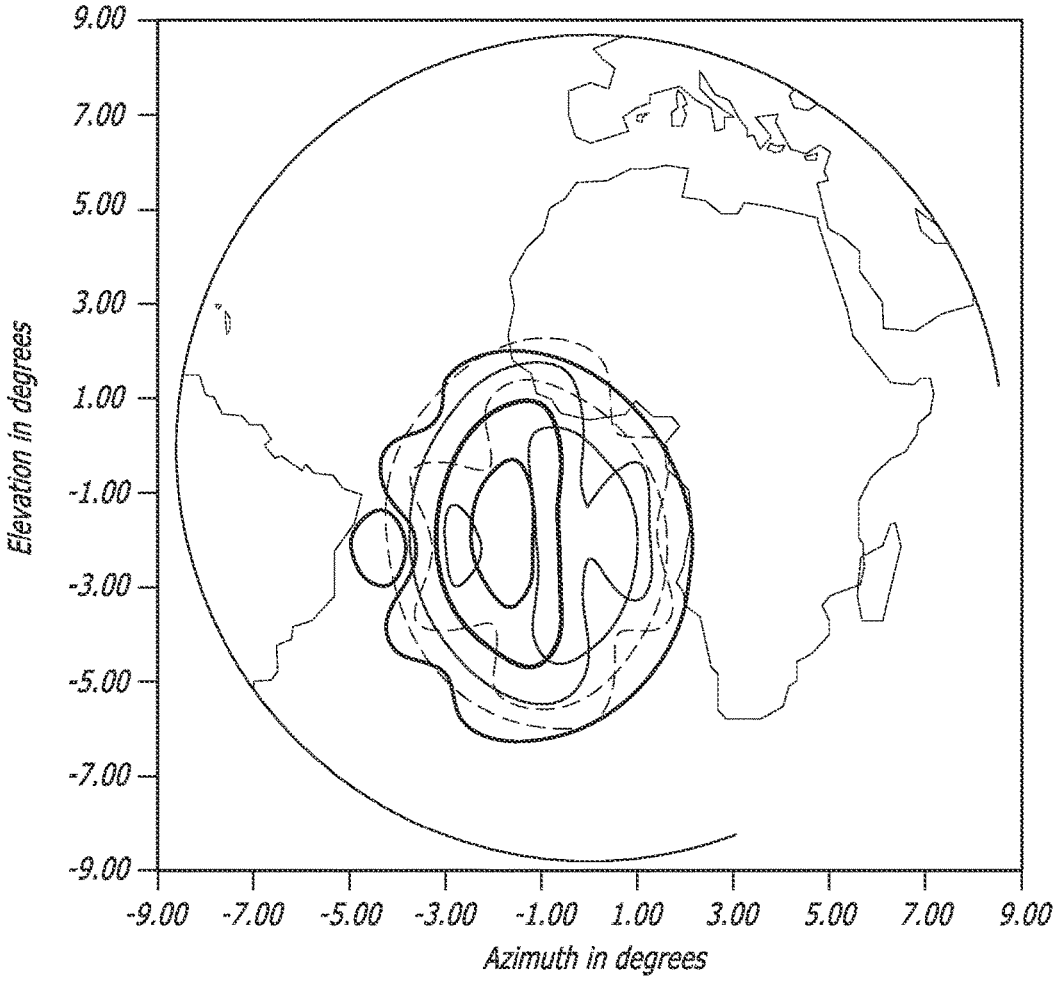
FIG. 15F is a graph showing exemplary antenna patterns on Earth for the beams of FIG. 15E.

FIG. 15E is a diagram showing the direction of beams 1550 formed with a diverging reflector 1520 with two feeds 1530, which are rotated in a diverging configuration, in accordance with at least one embodiment of the present disclosure. FIG. 15F is a graph showing exemplary antenna patterns on Earth for the beams 1550 of FIG. 15E.

Figure 16:
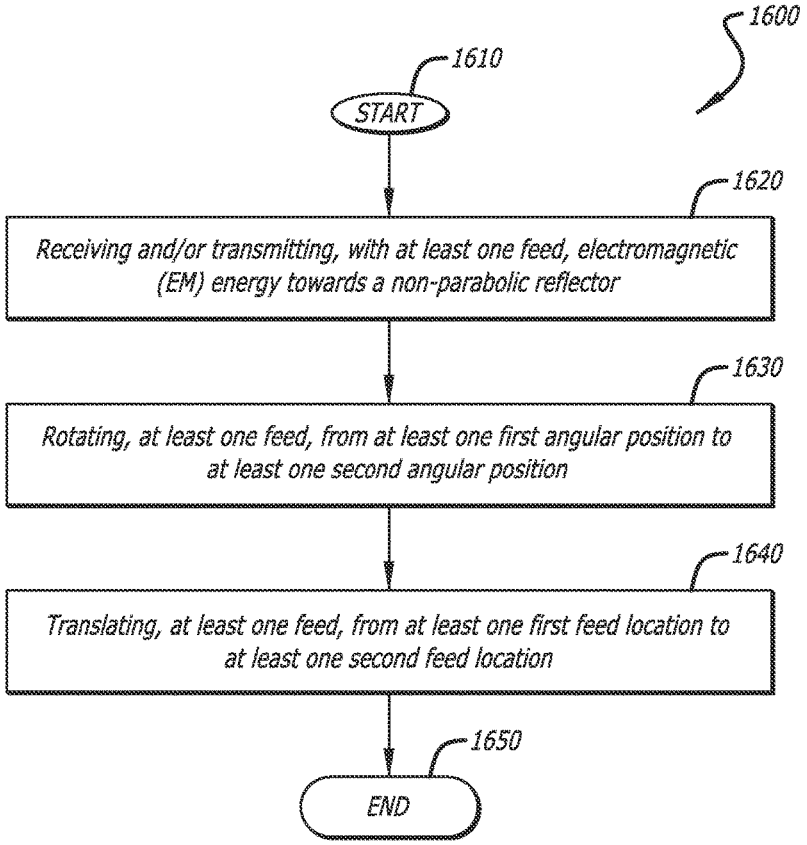

FIG. 16 depicts a flow chart 1600 depicting the disclosed method for feed re-pointing for multiple shaped beams reflector antennas, in accordance with at least one embodiment of the present disclosure. At the start 1610 of the method 1660, at least one feed receives and/or transmits electromagnetic (EM) energy towards a non-parabolic reflector 1620. As such, at least one feed is a transmit feed, a receive feed, and/or a transmit and receive feed. At least one feed may be linearly polarized or circularly polarized. The non-parabolic reflector comprises a converging surface or a diverging surface, and may comprise a deformable body. The reflected EM energy that is reflected from the non-parabolic reflector originates from and/or generates at least one beam.

At least one feed rotates from at least one first angular position to a least one second angular position, such that at least one beam shifts from at least one first coverage location to at least one second coverage location 1630. In one or more embodiments, at least one feed rotates in azimuth and/or elevation.

At least one feed, optionally, translates from at least one first feed location to at least one second feed location 1640. In one or more embodiments, at least one first feed location is at the focal point. At least one first coverage location and at least one second coverage location may be on Earth, a celestial body, a spacecraft, and/or a satellite. Then, the method 1600 ends 1650.

Although particular embodiments have been shown and described, it should be understood that the above discussion is not intended to limit the scope of these embodiments. While embodiments and variations of the many aspects of the present disclosure have been disclosed and described herein, such disclosure is provided for purposes of explanation and illustration only. Thus, various changes and modifications may be made without departing from the scope of the claims.

Where methods described above indicate certain events occurring in certain order, those of ordinary skill in the art having the benefit of this disclosure would recognize that the ordering may be modified and that such modifications are in accordance with the variations of the present disclosure. Additionally, parts of methods may be performed concurrently in a parallel process when possible, as well as performed sequentially. In addition, more parts or less part of the methods may be performed.

Accordingly, embodiments are intended to exemplify alternatives, modifications, and equivalents that may fall within the scope of the claims.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

We claim:

1. A method for re-pointing at least two beams, the method comprising:

at least one of directly receiving and directly transmitting, with at least two feeds, electromagnetic (EM) energy towards a non-parabolic reflector, which comprises one of a diverging surface or a converging surface, wherein reflected EM energy that is reflected from the non-parabolic reflector at least one of originates from and generates the at least one beam; and rotating each of the at least two feed to different angular positions than original angular positions of each of the at least two feeds such that the at least two feeds are configured in one of a diverging feed pointing configuration or a converging feed pointing configuration, thereby shifting each of the at least two beams to different coverage locations than original coverage locations of each of the at least two beams.

2. The method of claim 1, wherein the method further comprises: translating, at least one of the at least two feeds, from at least one first feed location to at least one second feed location.

3. The method of claim 2, wherein at least one of the at least one first feed location is at a focal point.

4. The method of claim 1, wherein the at least two feeds are each at least one of a transmit feed, a receive feed, and a transmit and receive feed.

5. The method of claim 1, wherein the at least two feeds are each one of a linearly polarized feed and circularly polarized feed.

6. The method of claim 1, wherein the different coverage locations are each located on at least one of Earth, a celestial body, a spacecraft, and a satellite.

7. The method of claim 1, wherein the original coverage locations are each located on at least one of Earth, a celestial body, a spacecraft, and a satellite.

8. The method of claim 1, wherein the non-parabolic reflector comprises a deformable body.

9. The method of claim 1, wherein the at least two feeds are each rotated in at least one of azimuth and elevation.

10. The method of claim 1, wherein when the non-parabolic reflector comprises the diverging surface and the at least two feeds are rotated in the diverging feed pointing configuration, the at least two beams shift in a converging manner.

11. The method of claim 1, wherein when the non-parabolic reflector comprises the diverging surface and the at least two feeds are rotated in the converging feed pointing configuration, the at least two beams shift in a diverging manner.

12. The method of claim 1, wherein when the non-parabolic reflector comprises the converging surface and the at least two feeds are rotated in the diverging feed pointing configuration, the at least two beams shift in a diverging manner.

13. The method of claim 1, wherein when the non-parabolic reflector comprises the converging surface and the at least two feeds are rotated in the converging feed pointing configuration, the at least two beams shift in a converging manner.

14. A system for re-pointing at least two beams, the system comprising:

a non-parabolic reflector, wherein reflected EM energy that is reflected from the non-parabolic reflector at least one of originates from and generates the at least one beam; and at least two feeds to at least one of directly receive and directly transmit electromagnetic (EM) energy towards the non-parabolic reflector, which comprises one of a diverging surface or a converging surface, and to rotate to different angular positions than original angular positions of each of the at least two feeds such that the at least two feeds are configured in one of a diverging feed pointing configuration or a converging feed pointing configuration, thereby shifting each of the at least two beams to different coverage locations than original coverage locations of each of the at least two beams.

15. The system of claim 14, wherein at least one of the at least two feeds is further to translate from at least one first feed location to at least one second feed location.

16. The system of claim 15, wherein at least one of the at least one first feed location is at a focal point.

17. The system of claim 14, wherein the at least two feeds are each at least one of a transmit feed, a receive feed, and a transmit and receive feed.

18. The system of claim 14, wherein the at least two feeds are each one of a linearly polarized feed and circularly polarized feed.

19. The system of claim 14, wherein the different coverage locations are each located on at least one of Earth, a celestial body, a spacecraft, and a satellite.

20. The system of claim 14, wherein the original coverage locations are each located on at least one of Earth, a celestial body, a spacecraft, and a satellite.

* * * * *